US011760456B2

(12) United States Patent
Varini et al.

(10) Patent No.: US 11,760,456 B2
(45) Date of Patent: Sep. 19, 2023

(54) SAIL FOR THE PROPULSION OF MEANS OF TRANSPORT

(71) Applicants: Nicola Varini, Mantova (IT); Otto Varini, Suzzara (IT); Luca Bertolini, Parma (IT)

(72) Inventors: Nicola Varini, Mantova (IT); Otto Varini, Suzzara (IT); Luca Bertolini, Parma (IT)

( * ) Notice: Subject to any disclaimer, the term of this patent is extended or adjusted under 35 U.S.C. 154(b) by 82 days.

(21) Appl. No.: 17/176,731

(22) Filed: Feb. 16, 2021

(65) Prior Publication Data

US 2021/0261227 A1 Aug. 26, 2021

(30) Foreign Application Priority Data

Feb. 20, 2020 (IT) ..... 102020000003440
Jul. 21, 2020 (IT) ..... 102020000017620

(51) Int. Cl.
*B63H 9/065* (2020.01)
*B63H 9/08* (2006.01)

(52) U.S. Cl.
CPC ..... *B63H 9/065* (2020.02); *B63H 9/08* (2013.01); *B63H 2009/086* (2013.01)

(58) Field of Classification Search
CPC ... B63H 9/00; B63H 9/04; B63H 9/06; B63H 9/065; B63H 9/067; B63H 9/08; B63H 2009/086
USPC ..... 114/114, 102.1, 102.15, 102.16, 102.22, 114/102.23, 102.24, 102.27
See application file for complete search history.

(56) References Cited

U.S. PATENT DOCUMENTS 4,823,720 A 4/1989 Foster
9,327,813 B2 * 5/2016 Dogliotti ..... B63H 9/067
9,481,432 B2 * 11/2016 Dogliotti ..... B63H 9/067

FOREIGN PATENT DOCUMENTS

EP 0614803 A1 9/1994

OTHER PUBLICATIONS

Italian Search Report and Written Opinion dated Oct. 30, 2020 issued in IT 202000003440, with partial translation.

* cited by examiner

*Primary Examiner* — Daniel V Venne
(74) *Attorney, Agent, or Firm* — Scully, Scott, Murphy & Presser, P.C.

(57) ABSTRACT

A sail for the propulsion of elements of transport, which comprises a sheet-like body made of flexible material which is connected, along one of its edges, to a supporting mast, connected to an element of transport. At least one stiffening rib is associated with the sheet-like body and is accommodated in a respective pocket which is formed in the sheet-like body and extends for at least one portion of the sheet-like body comprised between the supporting mast and the edge of the sheet-like body that is opposite to the one connected to the supporting mast; the rib has, or can assume on command, a substantially arc-like shape adapted to generate lift. Elements are further provided for varying the orientation of a concave part of the rib with respect to the supporting mast.

14 Claims, 32 Drawing Sheets

SAIL FOR THE PROPULSION OF MEANS OF TRANSPORT

The present invention relates to a sail for the propulsion of means of transport.

As is known, sails for the propulsion of means of transport, such as in particular boats or the like, are constituted by a flexible sheet-like body, made of a fabric or a membrane of synthetic material, which is supported by a mast, which extends upward and is connected in a downward region to the boat, and on which the wind acts so as to generate a propulsion force which allows to push the boats forward.

Typically, in sailing boats the primary sail or mainsail is kept under tension in the lower region by a beam, known in jargon as boom, which is articulated to the mast that supports the sail.

Usually, furthermore, one or more ribs are associated with the sail and are constituted by rods having a flattened shape and a rectilinear extension, made of rigid material, with respect to the sail body, which are inserted in adapted longitudinal pockets, formed in the sail itself, and allow to stiffen portions of the sail.

Typically, the ribs extend from the side of the sail, known as leech, that is opposite with respect to the side, known as luff, connected to the mast, toward said mast.

The methods for the forward travel of a sailboat with respect to the direction of the wind can be divided schematically into three types of point of sail: downwind points of sail, such as for example the points of sail known as broad reach and running, in which the boat is propelled by the wind; beam reaches; and close-hauled, such as for example, beating or close reach, in which the boat moves substantially against the direction from which the wind is coming at a certain angle.

In order to allow the forward travel of the boat in close-hauled points of sail, it is essential that the sail assume, under the thrust of the wind, a wing profile-like shape, so as to create a pressure difference between one face of the sail and the other which is capable of generating the propelling force that allows the forward travel of the boat.

In the case of close-hauled points of sail, the subdivision of the different points of sail into the beating and close reach types is an extreme simplification.

In fact, the numerous parameters, such as for example, strength and direction of the wind, course, currents, waves and so forth, that come into play during close-hauled sailing and the combination thereof require, in order to obtain the best performance, different adjustments of the sail that allow to vary the shape thereof assumed when said sail is exposed to the wind.

Currently, sails can be adjusted by means of various devices, among which it is possible to mention for example: the so-called "yang", constituted by a tackle that allows to modify the base angle of the boom; the so-called "leech line", constituted by a line which, conveniently tensioned, modifies the length of the base of the mainsail; the so-called "outhaul", constituted by a line that allows to adjust the tension of the base of the mainsail; the so-called "backstay", constituted by a cable which, conveniently tensioned, allows to bend the mast that supports the sail toward the bow or toward the stern; the so-called "traveler", constituted by a carriage that moves laterally, to the right or to the left, with respect to the travel direction of the boat, the retention of the line, termed "sheet", that allows to steer the sail.

The adjustments allowed by these devices and their combinations allow to make the sail assume the most efficient geometric shape in relation to the set course of the boat and to the wind conditions that are experienced.

However, it is important to stress that according to the background art, the sail, under the thrust of the wind, passively assumes the shape that is determined by the action applied by the above mentioned devices, which, however, act only on the perimeter of said sail.

Moreover, it should be noted that in order to reach an upwind point in the shortest time, in beating one tends to follow the course with the narrowest possible angle with respect to the direction of the wind.

As a result, the axis of the hull is displaced with respect to the set course, albeit for a short time, and therefore with sails according to the background art the sail "rejects" the wind, i.e., it partially deflates and loses its lift, with a consequent reduction of the speed of the boat.

The aim of the present invention is to provide a sail for the propulsion of means of transport that is capable of improving the background art in one or more of the aspects mentioned above.

Within this aim, an object of the invention is to provide a sail for the propulsion of means of transport that can assume in a stable manner a wing profile-like shape regardless of the angle of incidence of the wind.

Another object of the invention is to provide a sail for the propulsion of means of transport that allows a more direct adjustment of its shape with respect to the background art.

Another object of the present invention is to provide a sail for the propulsion of means of transport that is capable of combining the performance advantages of rigid sails with the practicality and cost advantages of traditional sails.

Another object of the invention is to provide a sail for the propulsion of means of transport that can be mounted on existing boats without requiring modifications thereto.

Another object of the invention is to provide a sail for the propulsion of means of transport that can offer the greatest assurances of reliability and safety during its use.

A further object of the present invention is to overcome the drawbacks of the background art in a manner that is alternative to any existing solutions.

Not least object of the invention is to provide a sail for the propulsion of means of transport that can be constructively simple to provide and can be manufactured at competitive costs.

This aim and these and other objects that will become better apparent hereinafter are achieved by a sail for the propulsion of means of transport according to claim 1, optionally provided with one or more of the characteristics of the dependent claims.

Further characteristics and advantages of the invention will become better apparent from the description of preferred but not exclusive embodiments of the sail for the propulsion of means of transport according to the invention, illustrated by way of non-limiting example in the accompanying drawings, wherein.

Figure 1:
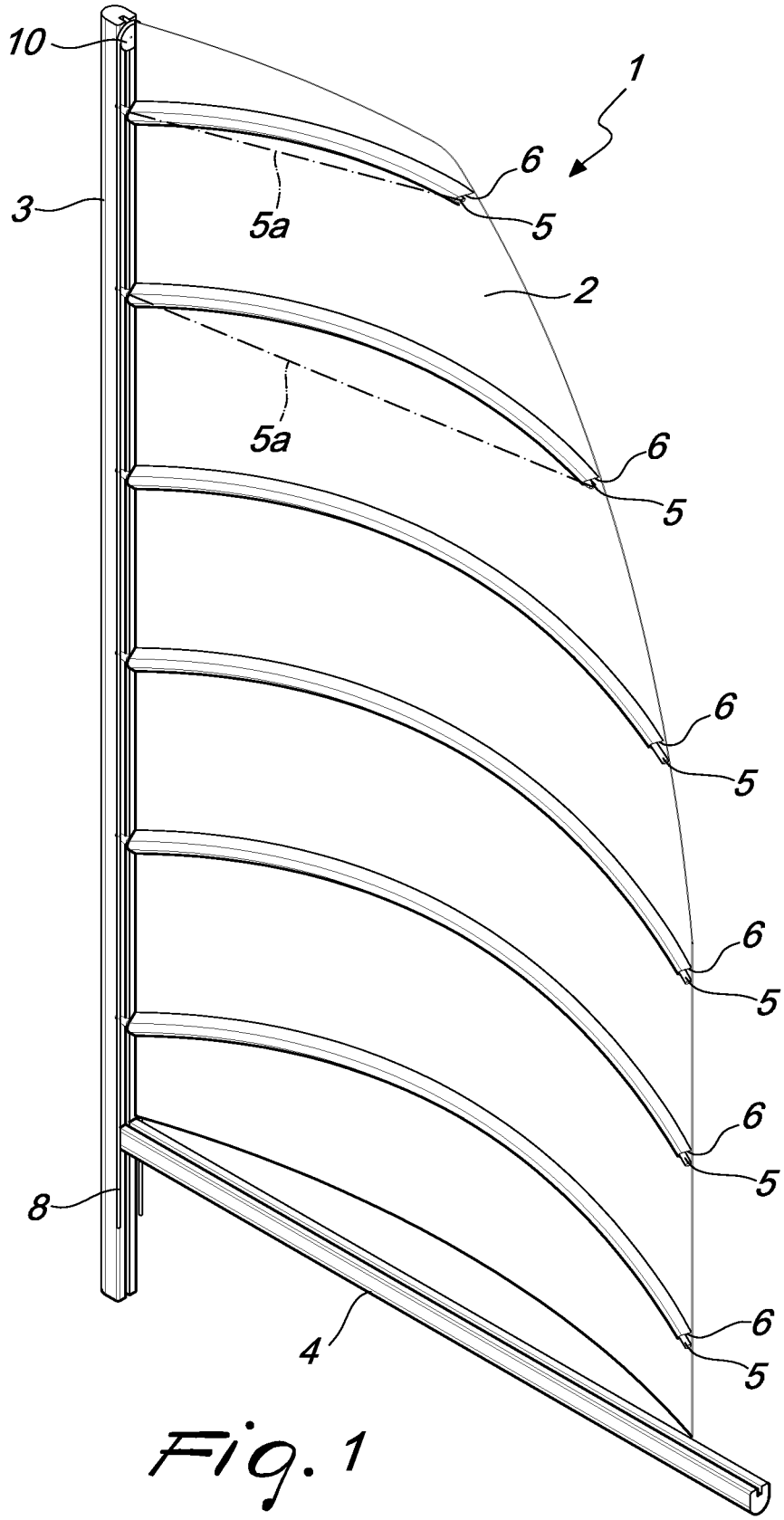
FIG. 1 is a perspective view of the sail according to the invention in a first embodiment.
Figure 2:
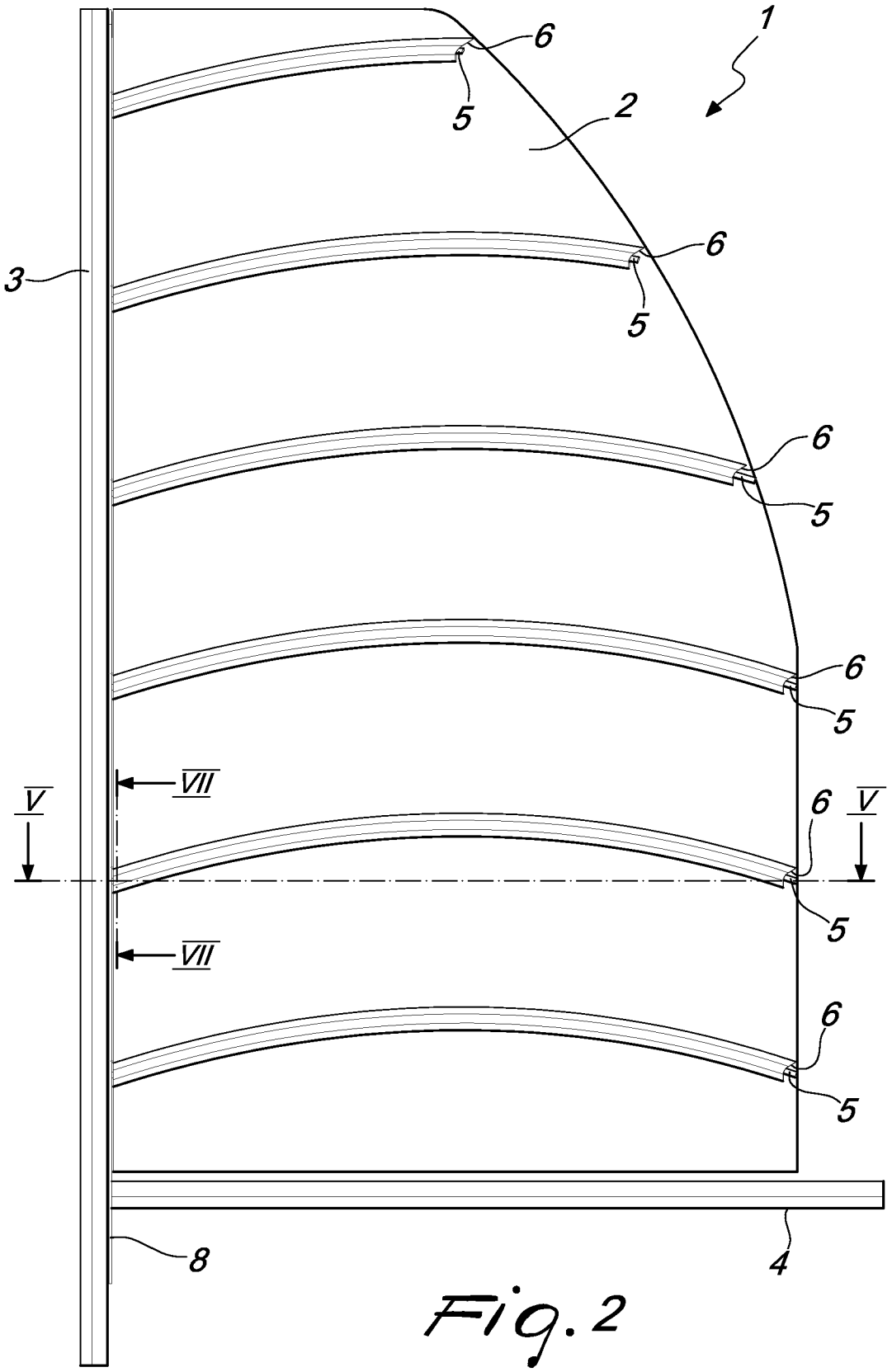
FIG. 2 is a front view of the first embodiment of the sail according to the invention.
Figure 3:
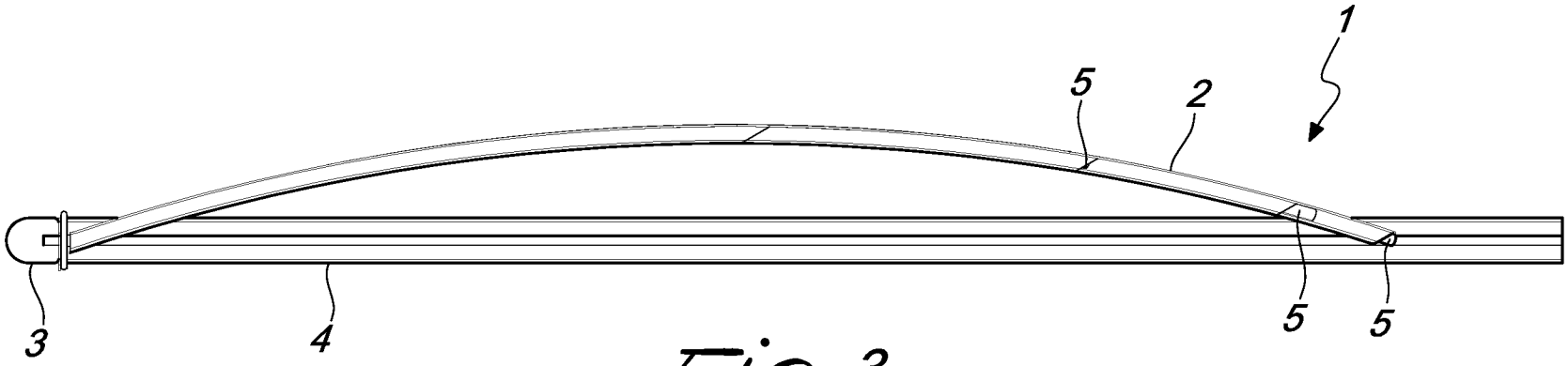
FIG. 3 is a top plan view of the sail according to the invention in the first embodiment.
Figure 4:
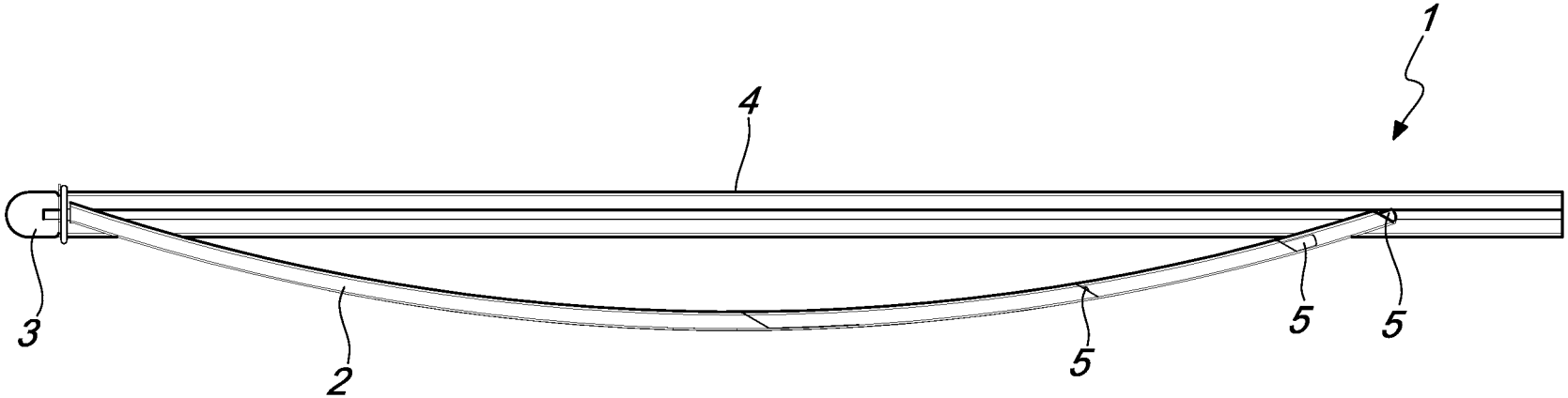
FIG. 4 is a top plan view of the first embodiment of the sail according to the invention with a different orientation of the ribs with respect to FIG. 3.
Figure 5:
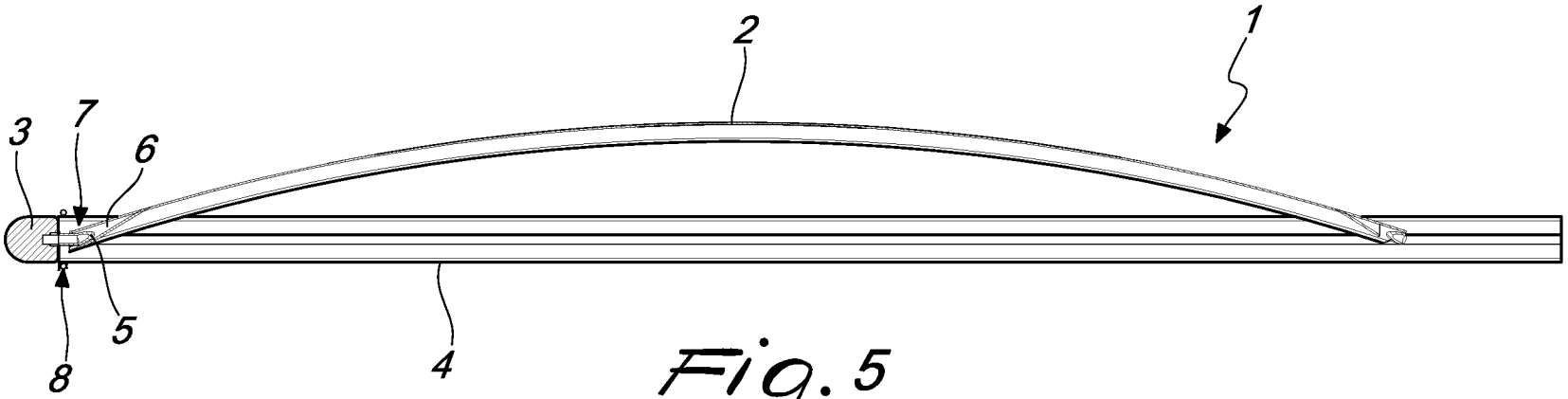
FIG. 5 is a sectional view taken along the plane V-V of FIG. 2.
Figure 6:
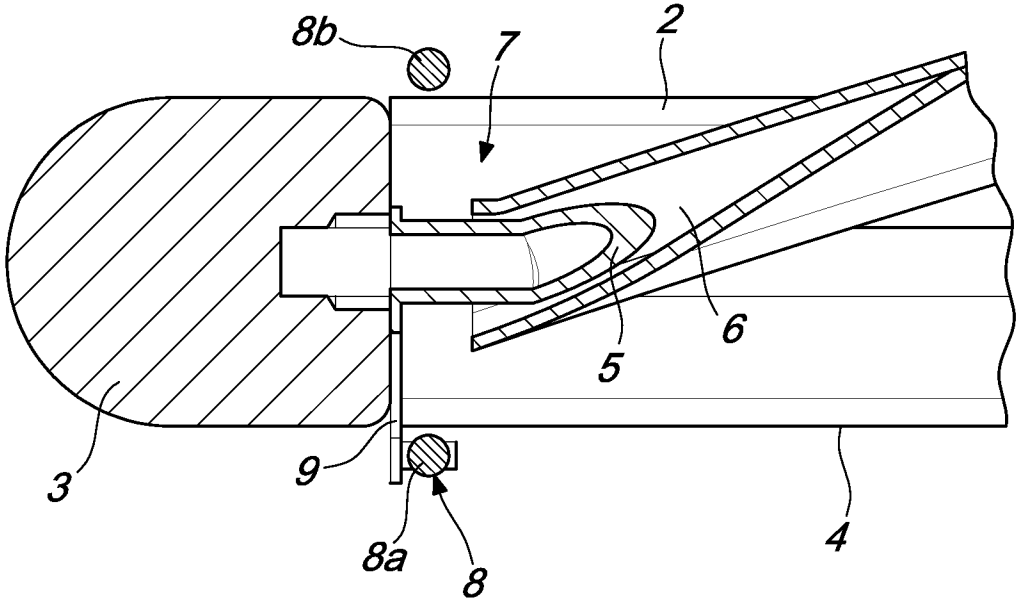
FIG. 6 is an enlarged-scale view of a detail of FIG. 5.
Figure 7:
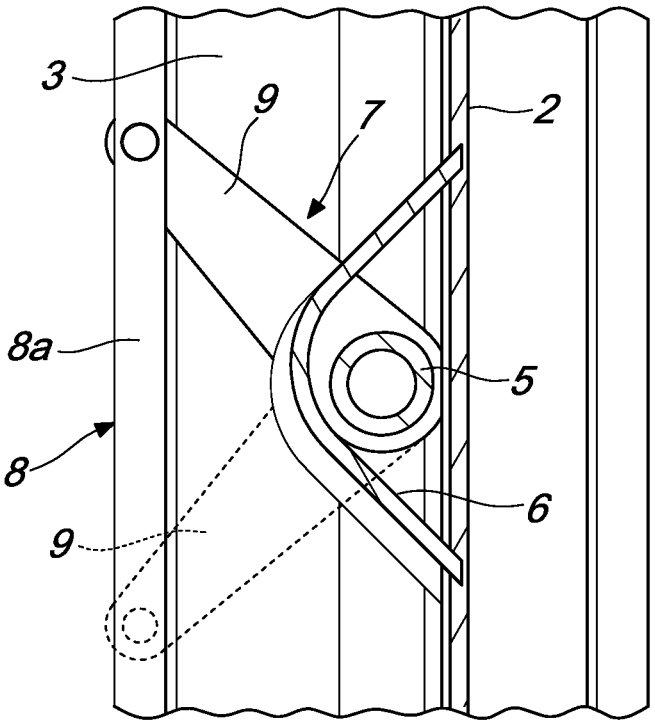
FIG. 7 is a sectional view taken along the plane VII-VII of FIG. 2.
Figure 8:
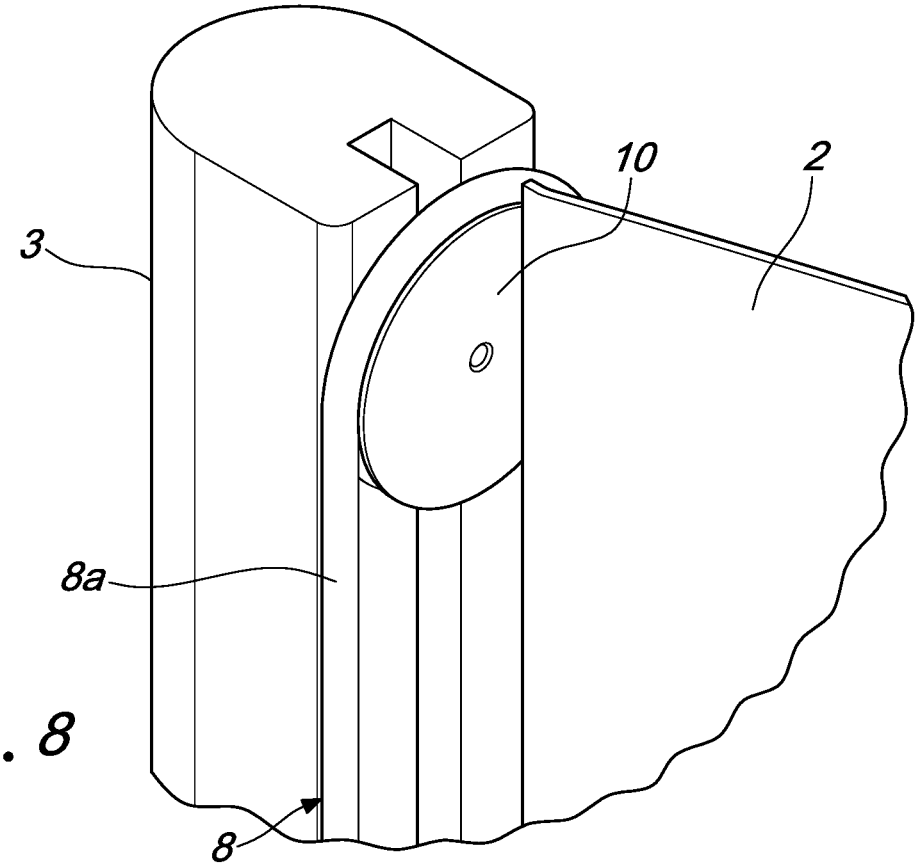
FIG. 8 is a perspective view of a detail of the first embodiment of the sail according to the invention at the top of a supporting mast of the sail.
Figure 9:
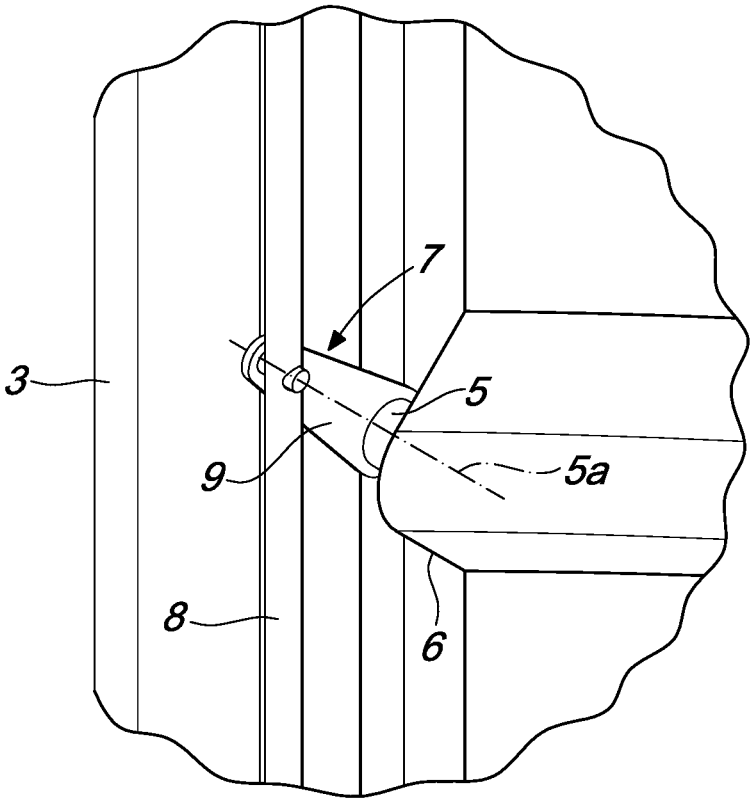
FIG. 9 is an enlarged-scale perspective view of a detail of the first embodiment of the sail according to the invention at one end of a rib of the sail.
Figure 10:
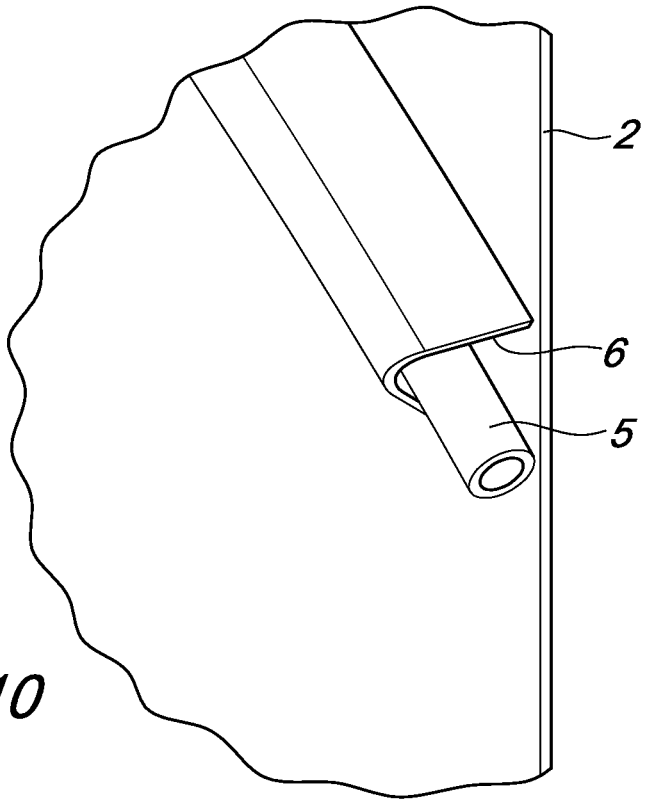
FIG. 10 is an enlarged-scale perspective view of a detail of the first embodiment of the sail according to the invention at the other end of a rib of the sail.
Figure 11:
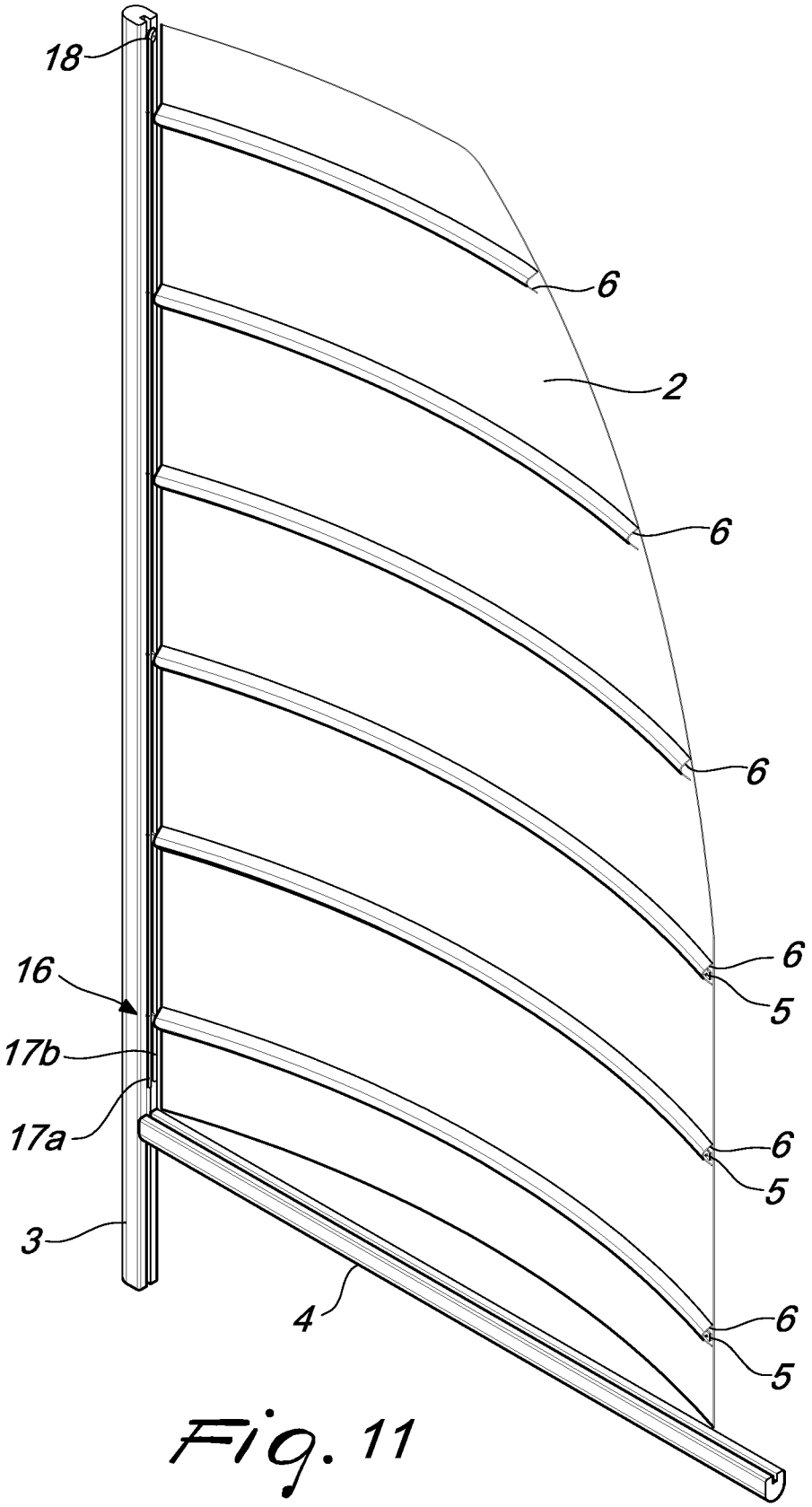
FIG. 11 is a perspective view of a second embodiment of the sail according to the invention.
Figure 12:
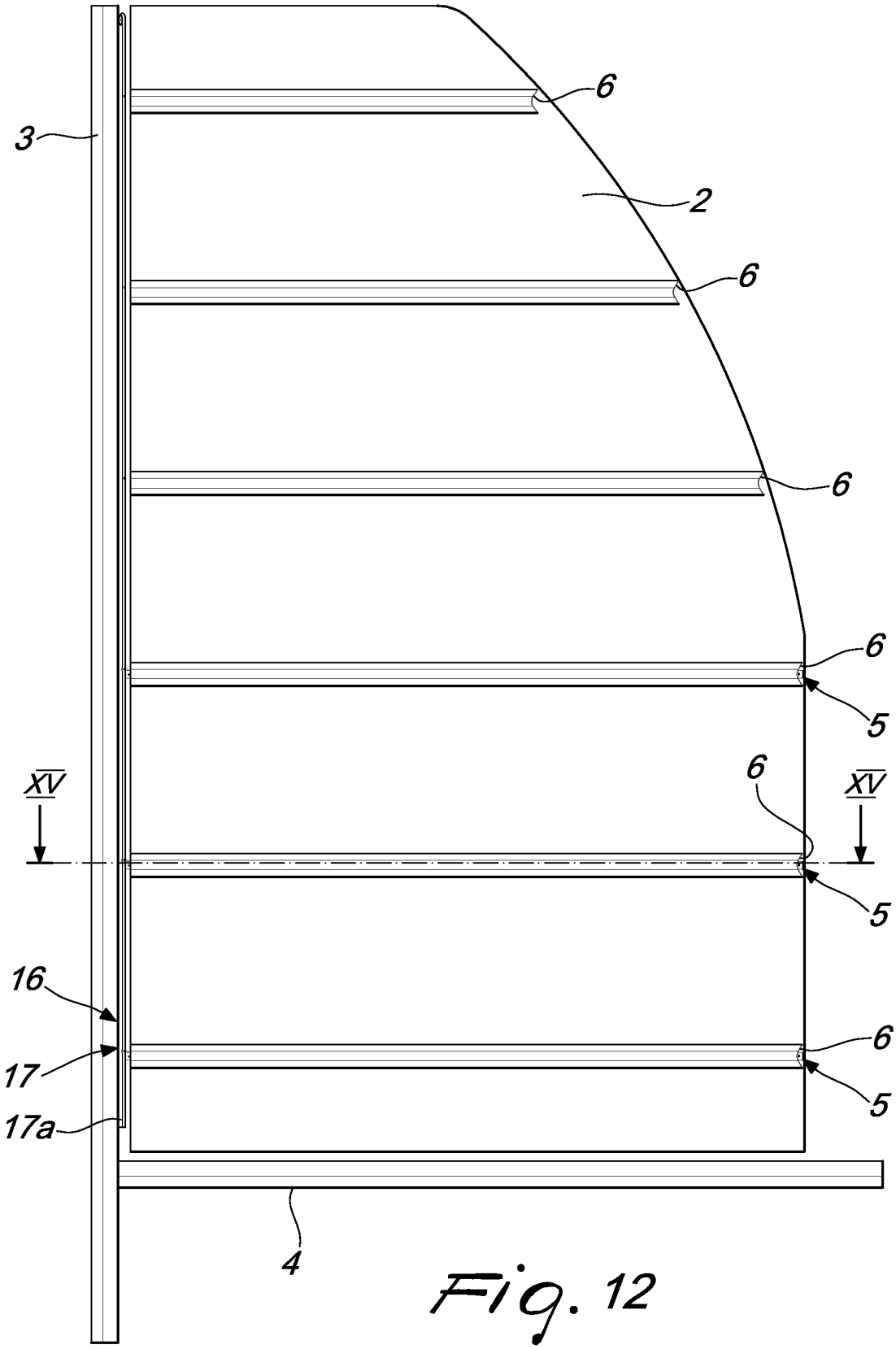
FIG. 12 is a front view of the second embodiment of the sail according to the invention.
Figure 13:
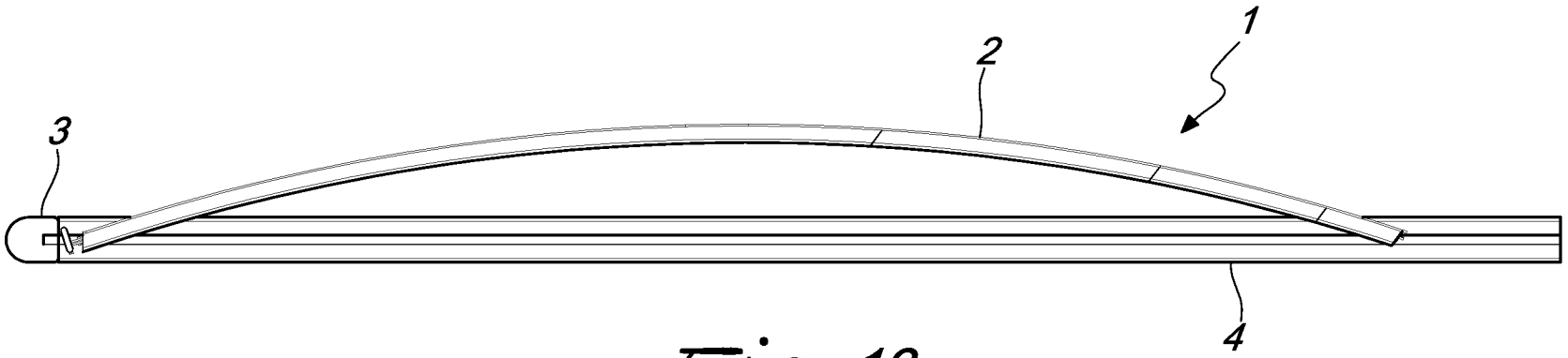
FIG. 13 is a top plan view of the second embodiment of the sail according to the invention.
Figure 14:
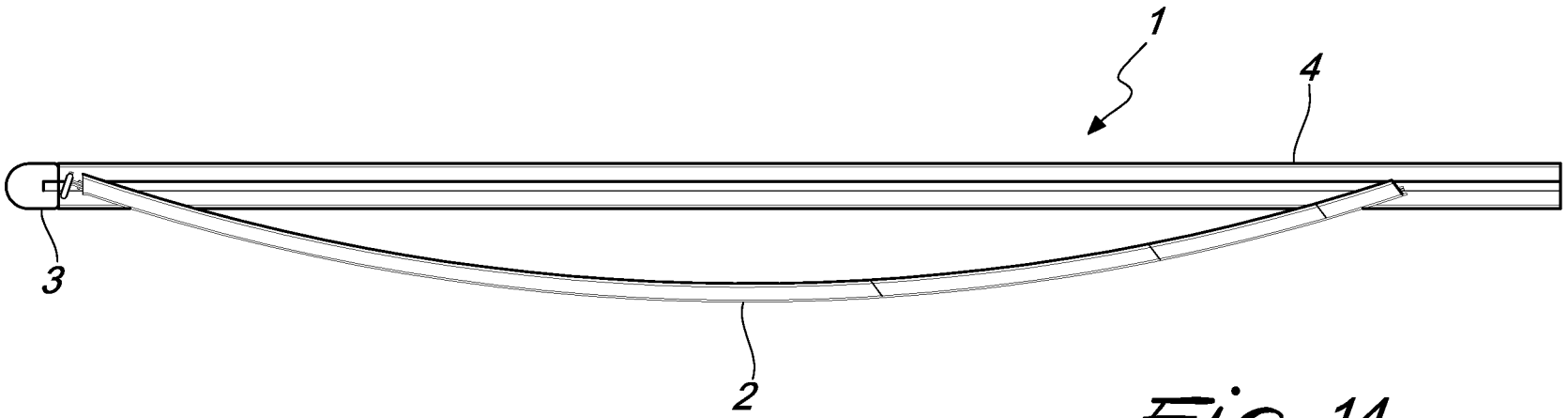
FIG. 14 is again a top view of the second embodiment of the sail according to the invention but with a different orientation of the ribs of the sail with respect to FIG. 13.
Figure 15:
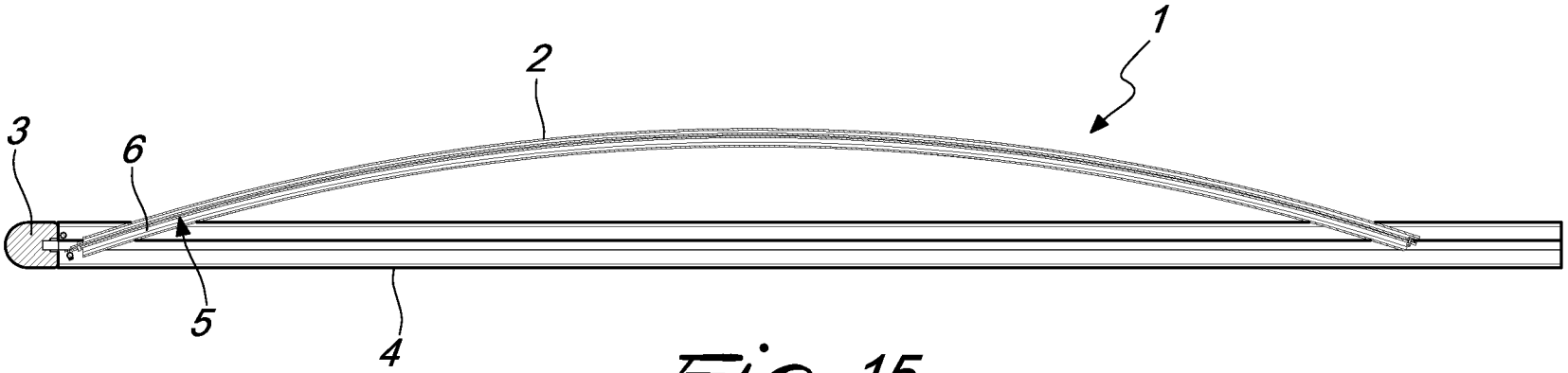
FIG. 15 is a sectional view taken along the plane XV-XV of FIG. 12.
Figure 16:
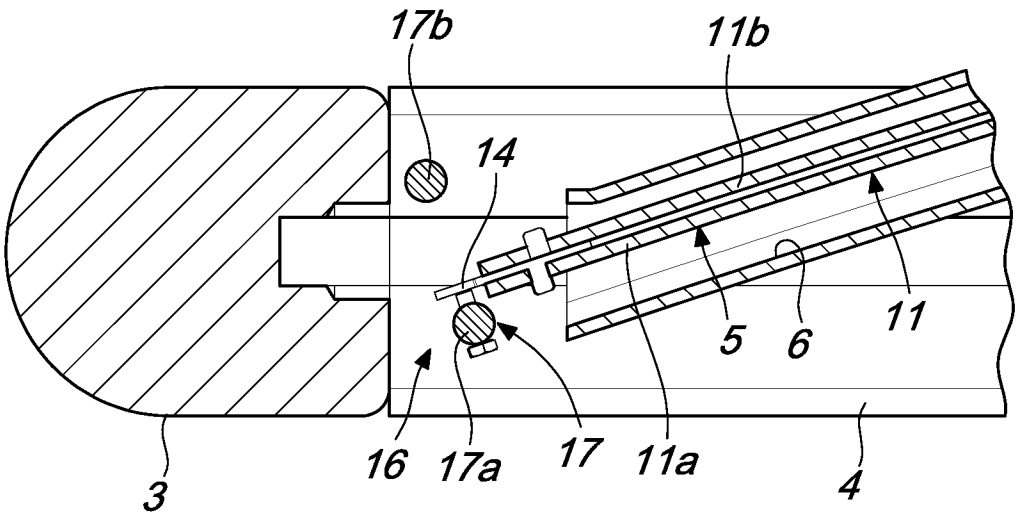
FIG. 16 is an enlarged-scale view of a detail of FIG. 15.
Figure 17:
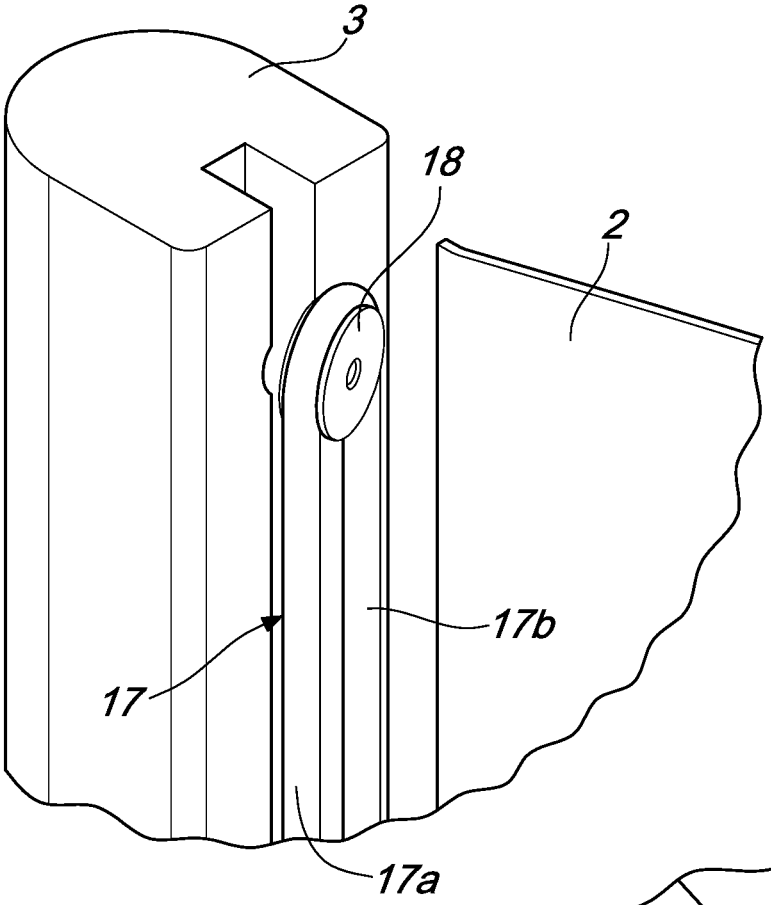
FIG. 17 is an enlarged-scale perspective view of a detail of the second embodiment of the sail according to the invention at the top of the supporting mast of the sail.
Figure 19:
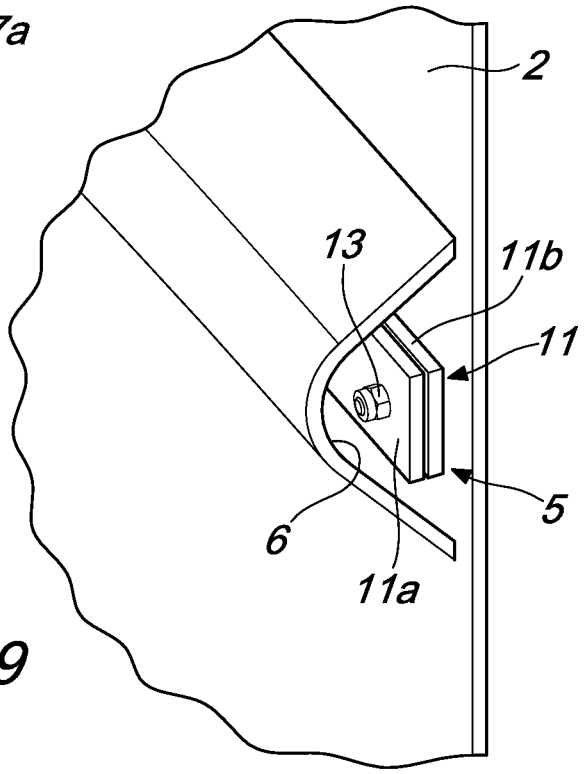
FIG. 19 is an enlarged-scale perspective view of a detail of the second embodiment of the sail according to the invention at the other end of the rib.
Figure 18:
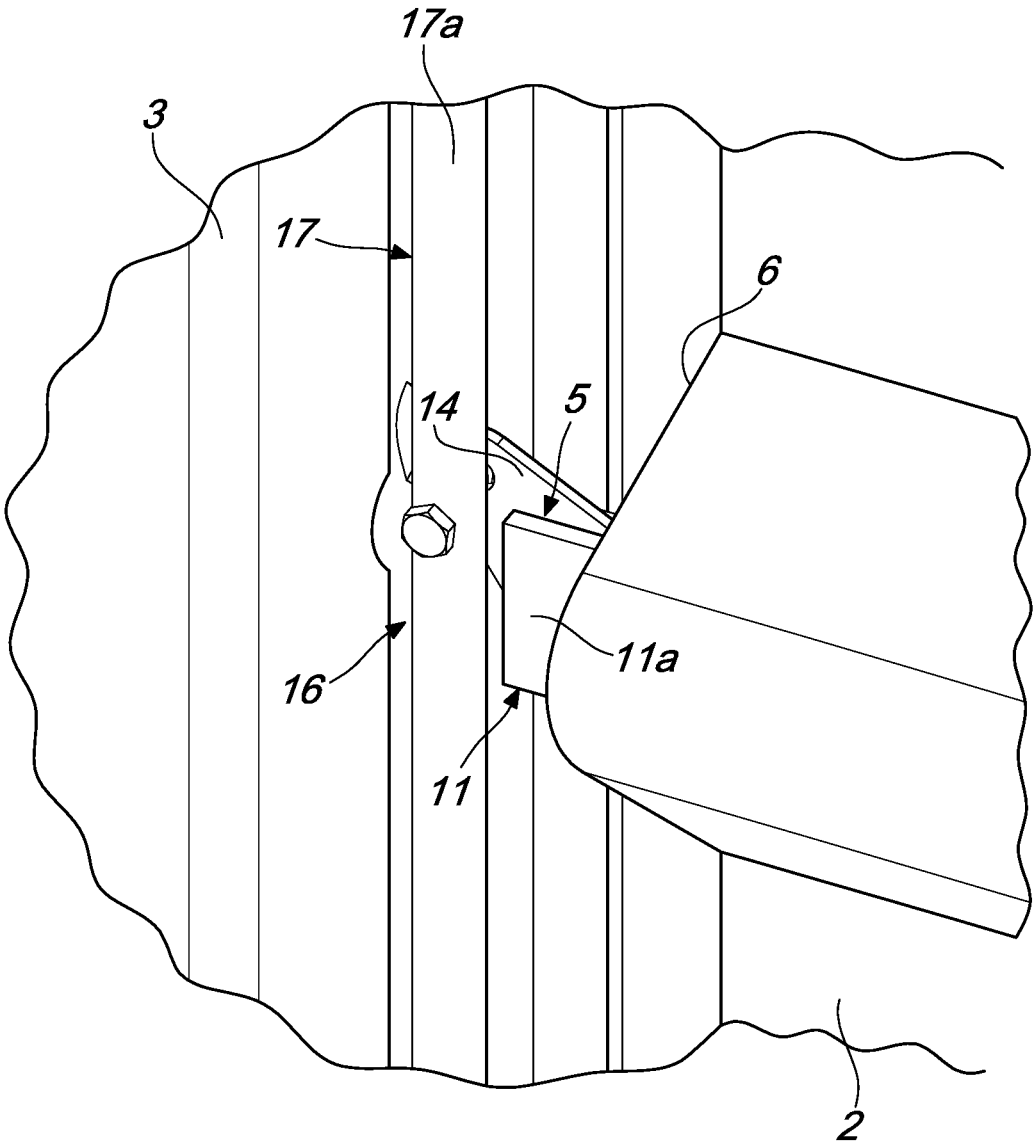
FIG. 18 is an enlarged-scale perspective view of a detail of the second embodiment at one end of a rib of the sail.
Figure 20:
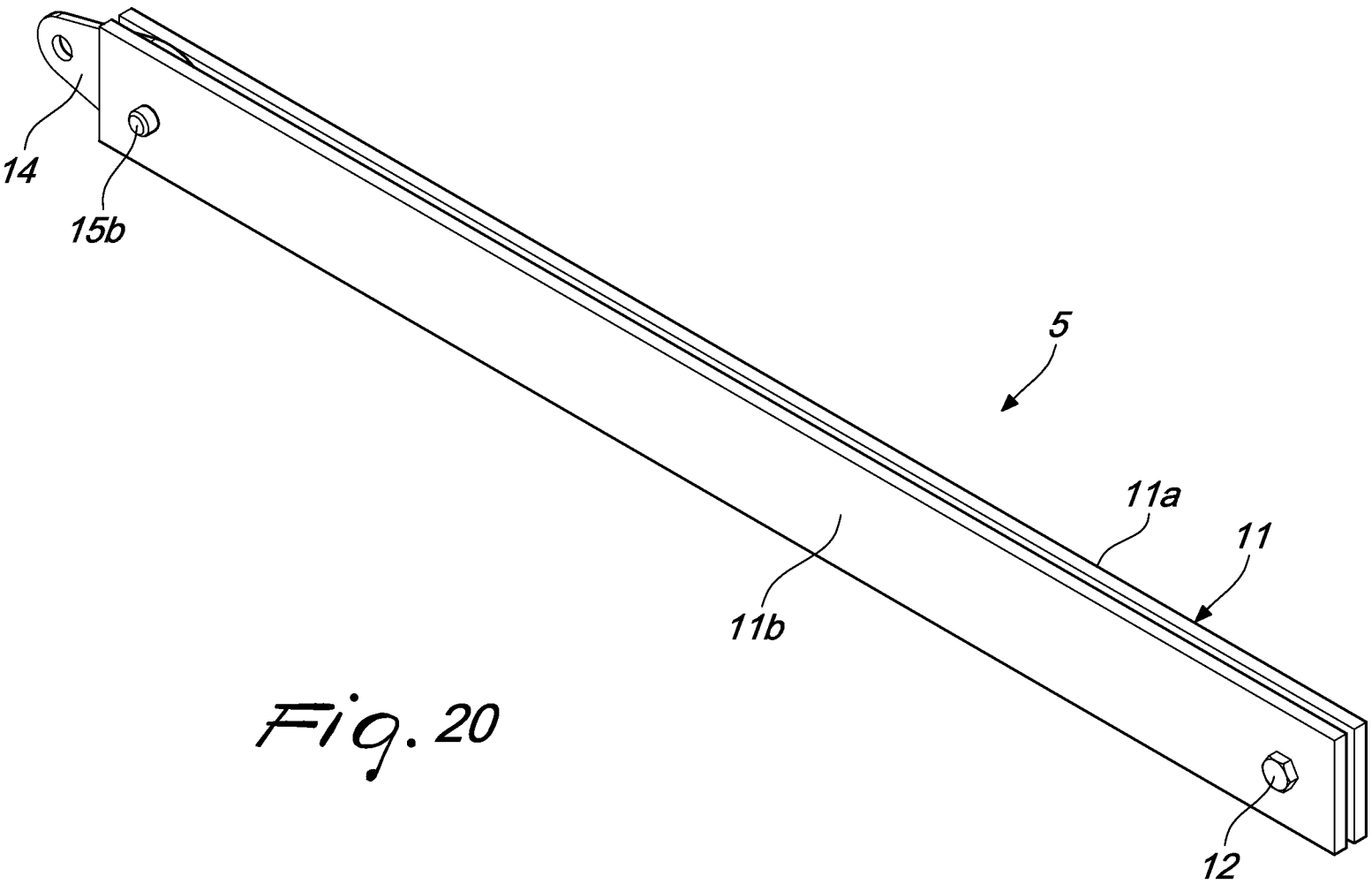
FIG. 20 is a perspective view of a rib of the second embodiment of the sail according to the invention in a rectilinear condition.
Figure 21:
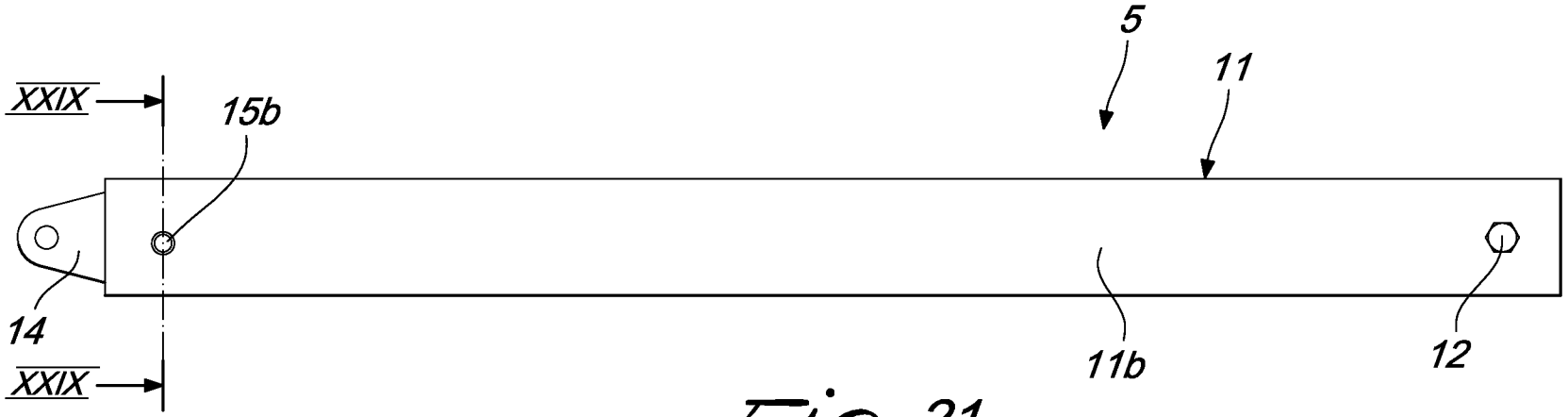
FIG. 21 is a front elevation view of the rib of the second embodiment of the sail according to the invention in the rectilinear condition.
Figure 22:
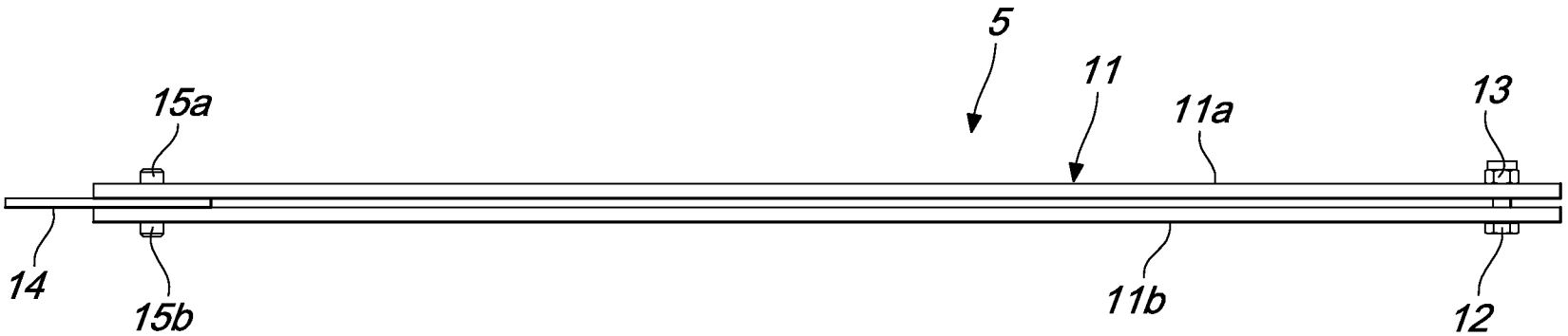
FIG. 22 is a top plan view of the rib of the second embodiment of the sail according to the invention in the rectilinear condition.
Figure 23:
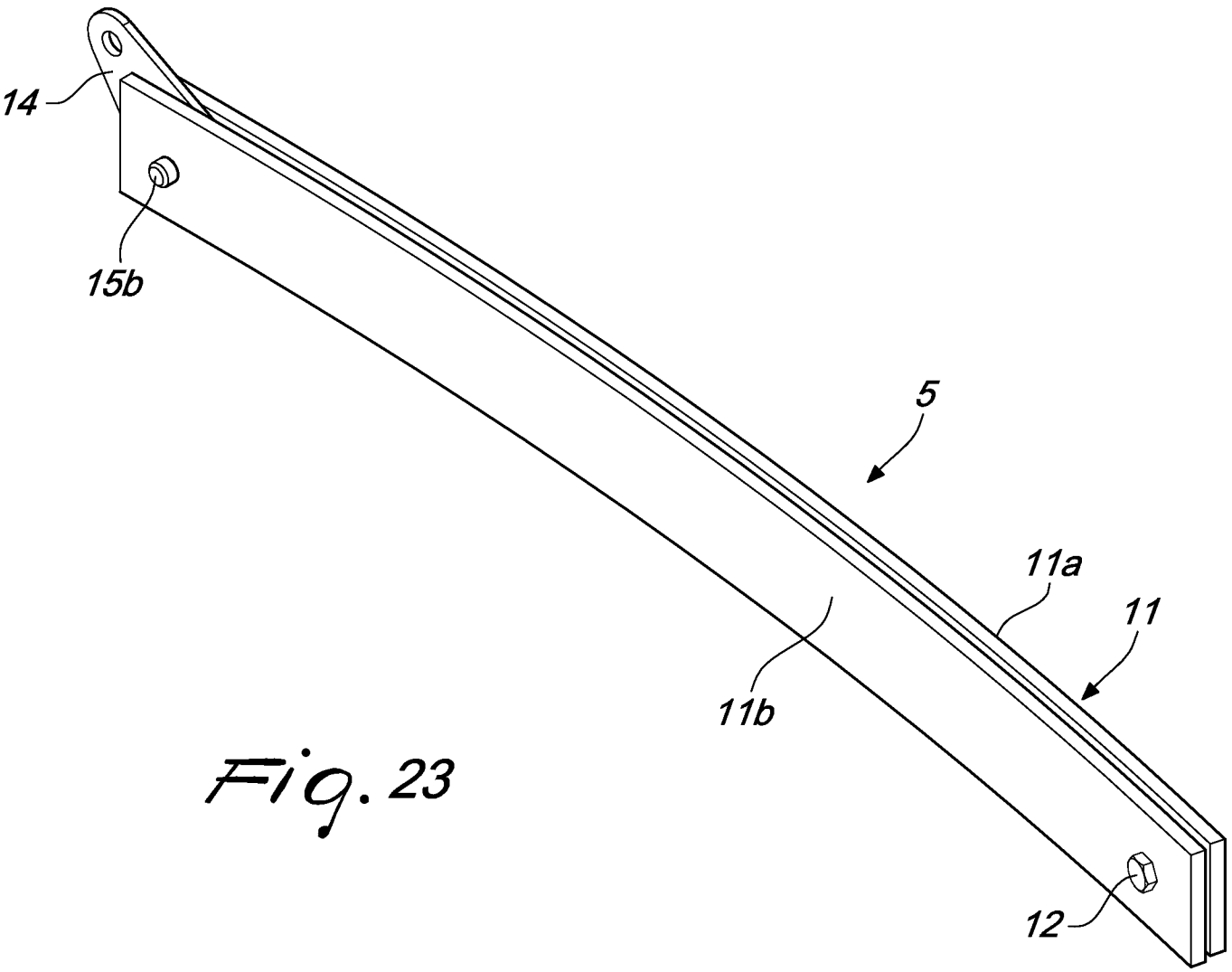
FIG. 23 is a perspective view of the rib of the second embodiment of the sail according to the invention in a first arc-like condition.
Figure 24:
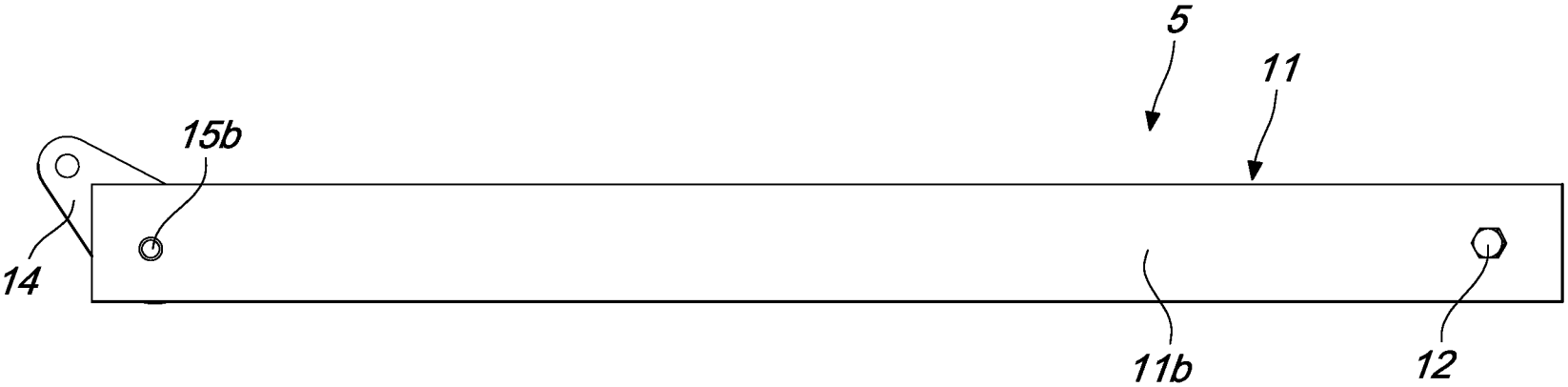
FIG. 24 is a front elevation view of the rib of the second embodiment of the sail according to the invention in the first arc-like condition.
Figure 25:
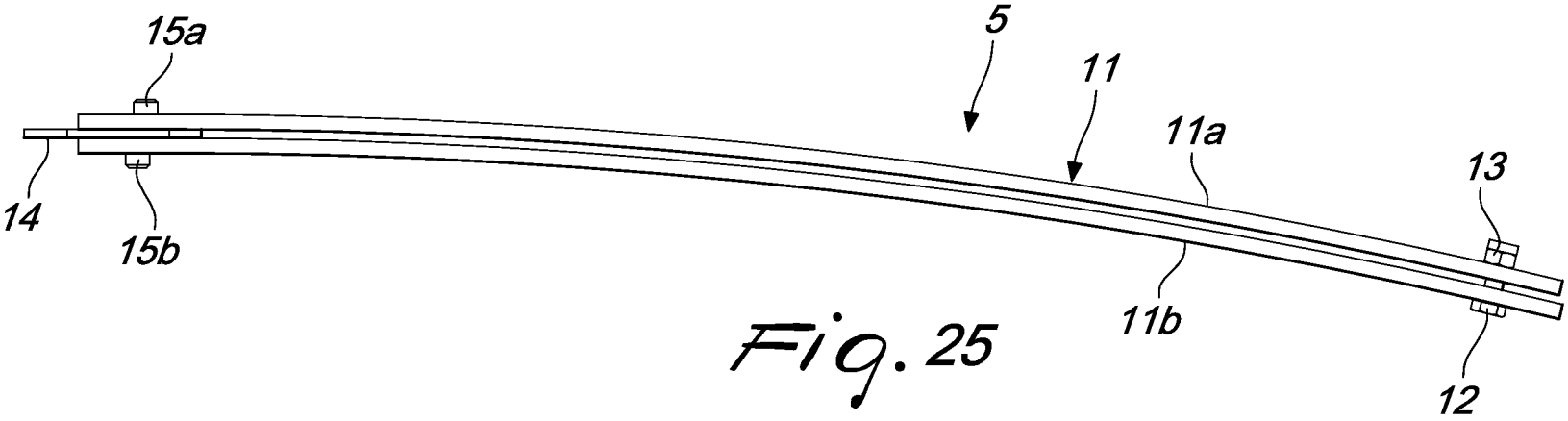
FIG. 25 is a top plan view of the rib of the second embodiment of the sail according to the invention in the first arc-like condition.
Figure 26:
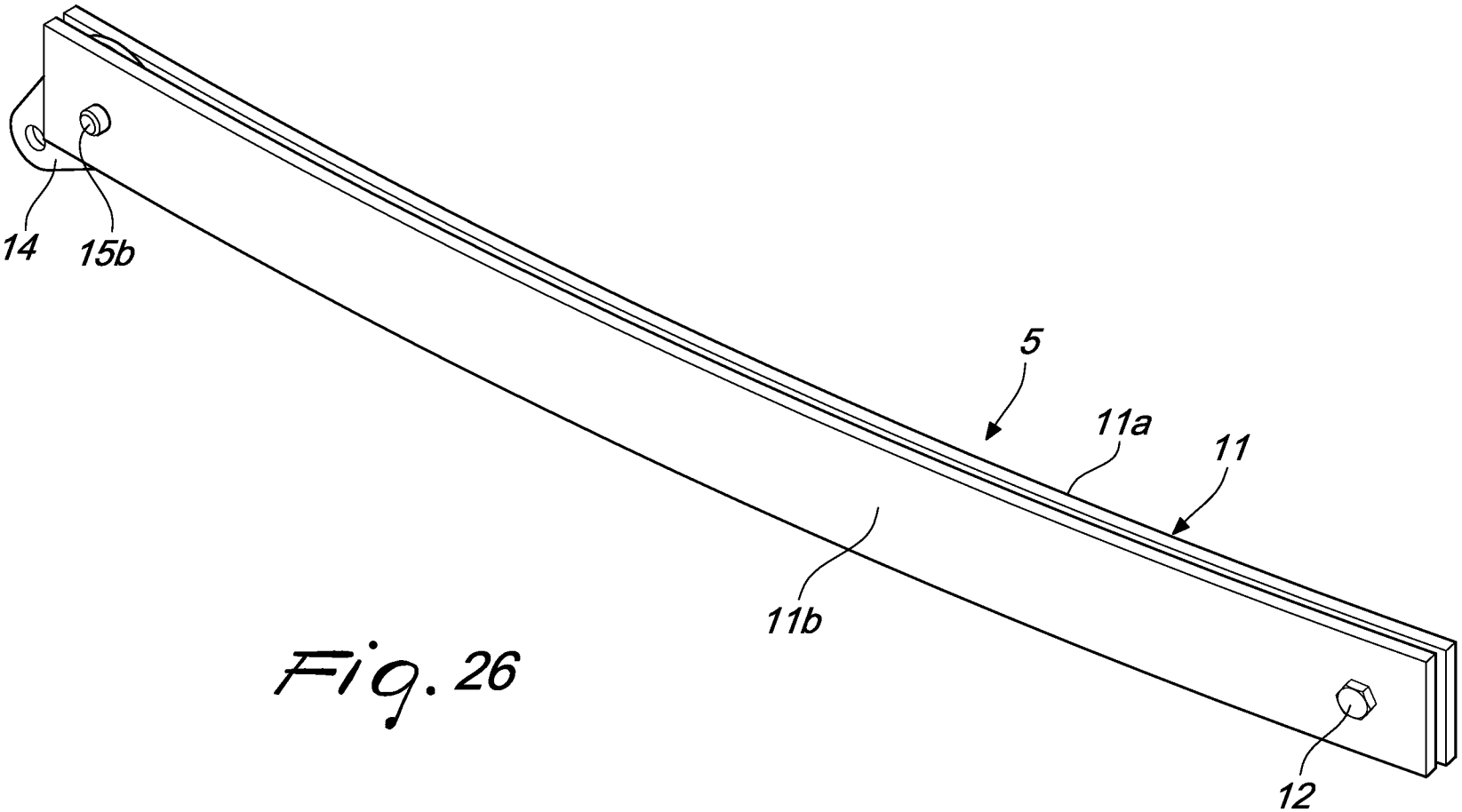
FIG. 26 is a perspective view of the rib of the second embodiment of the sail according to the invention in a second arc-like condition.
Figure 27:
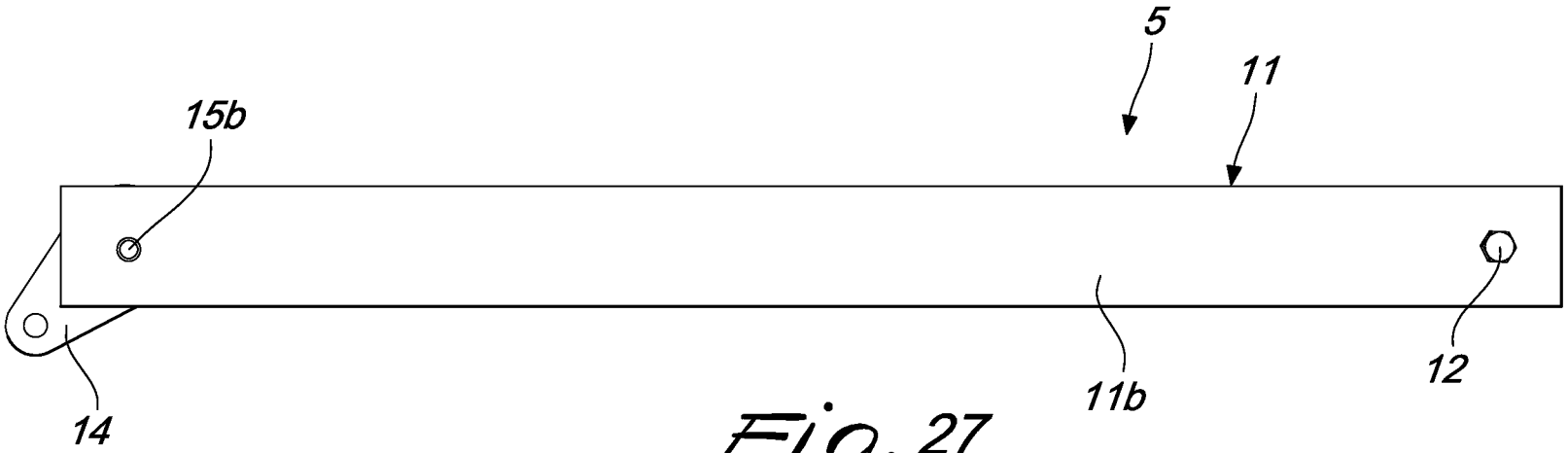
FIG. 27 is a front elevation view of the rib of the second embodiment of the sail according to the invention in the second arc-like condition.
Figure 28:
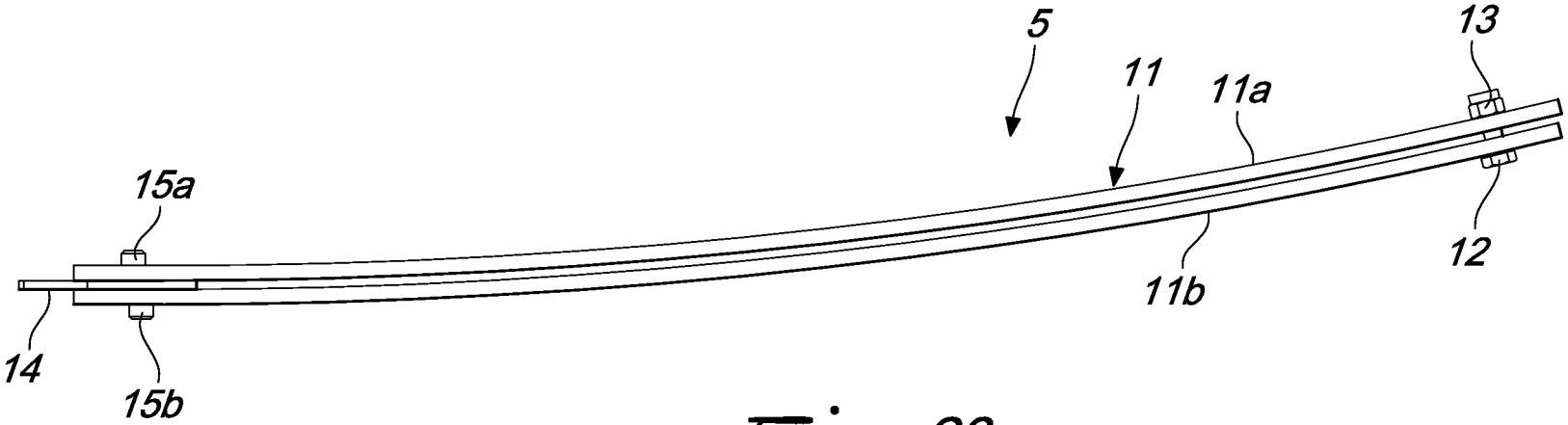
FIG. 28 is a top plan view of the rib of the second embodiment of the sail according to the invention in the second arc-like condition.
Figure 29:
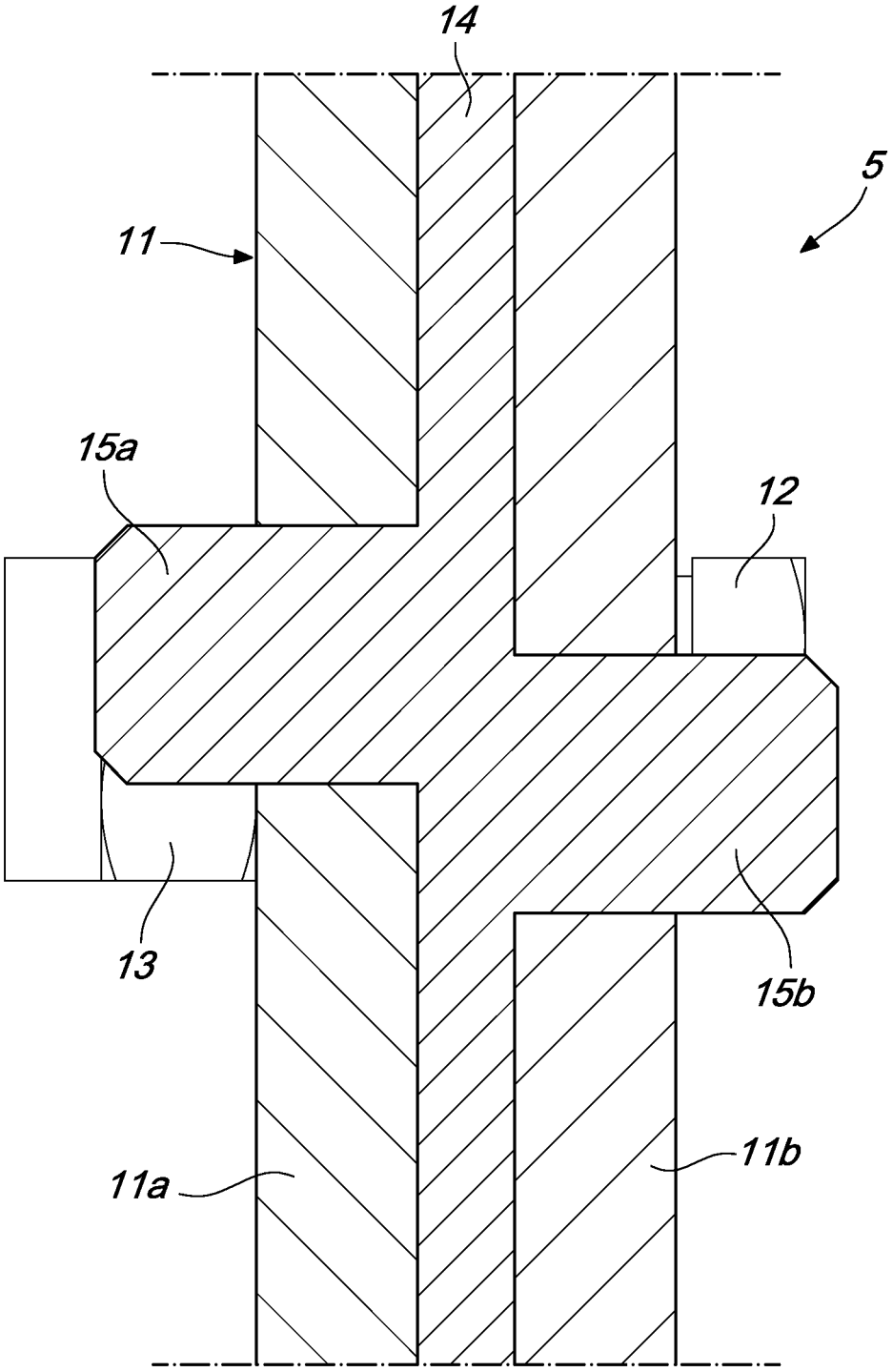
FIG. 29 is a sectional view taken along the plane XXIX-XXIX of FIG. 21.
Figure 30:
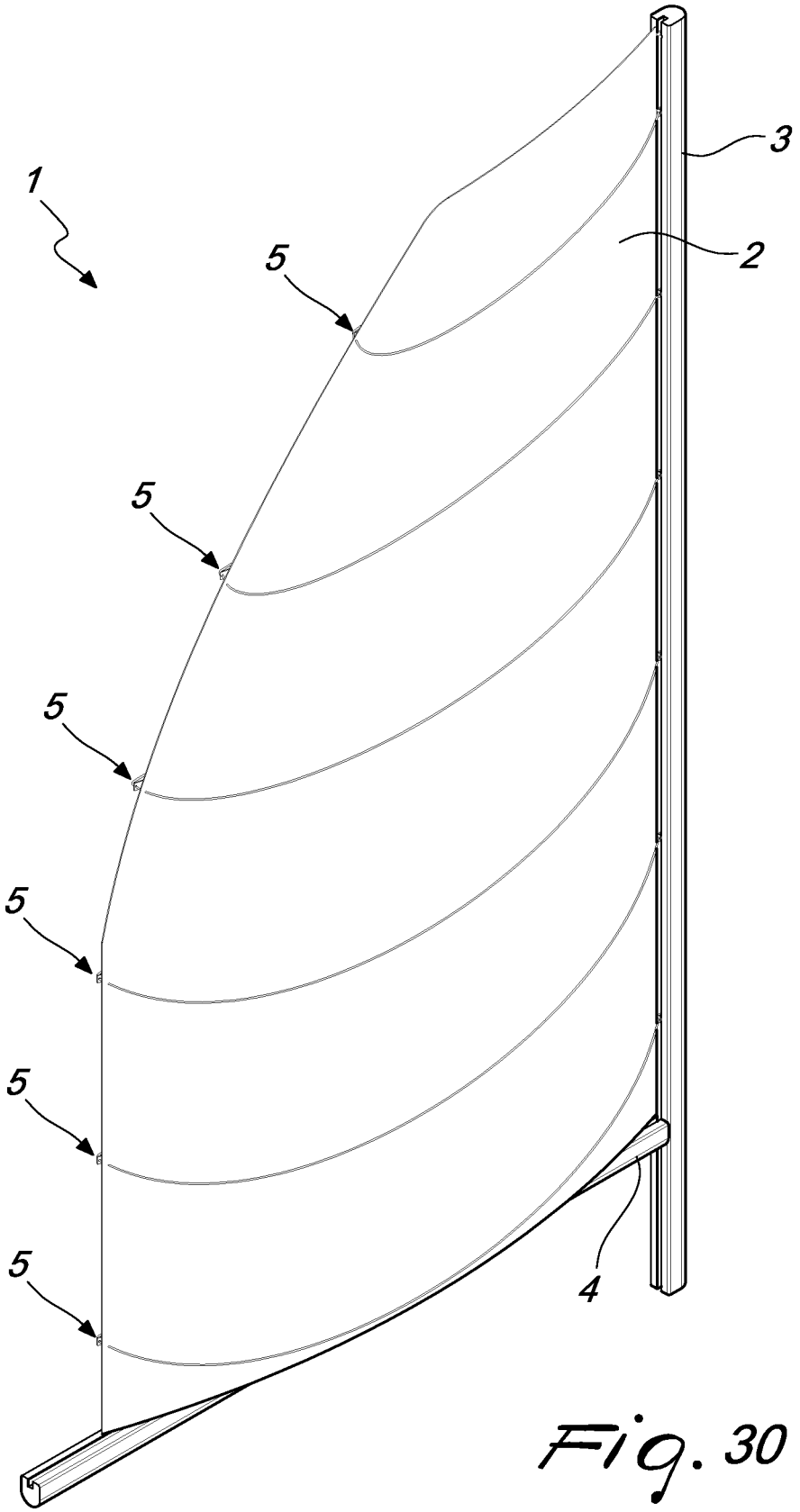
FIG. 30 is a perspective view of a third embodiment of the sail according to the invention.
Figure 31:
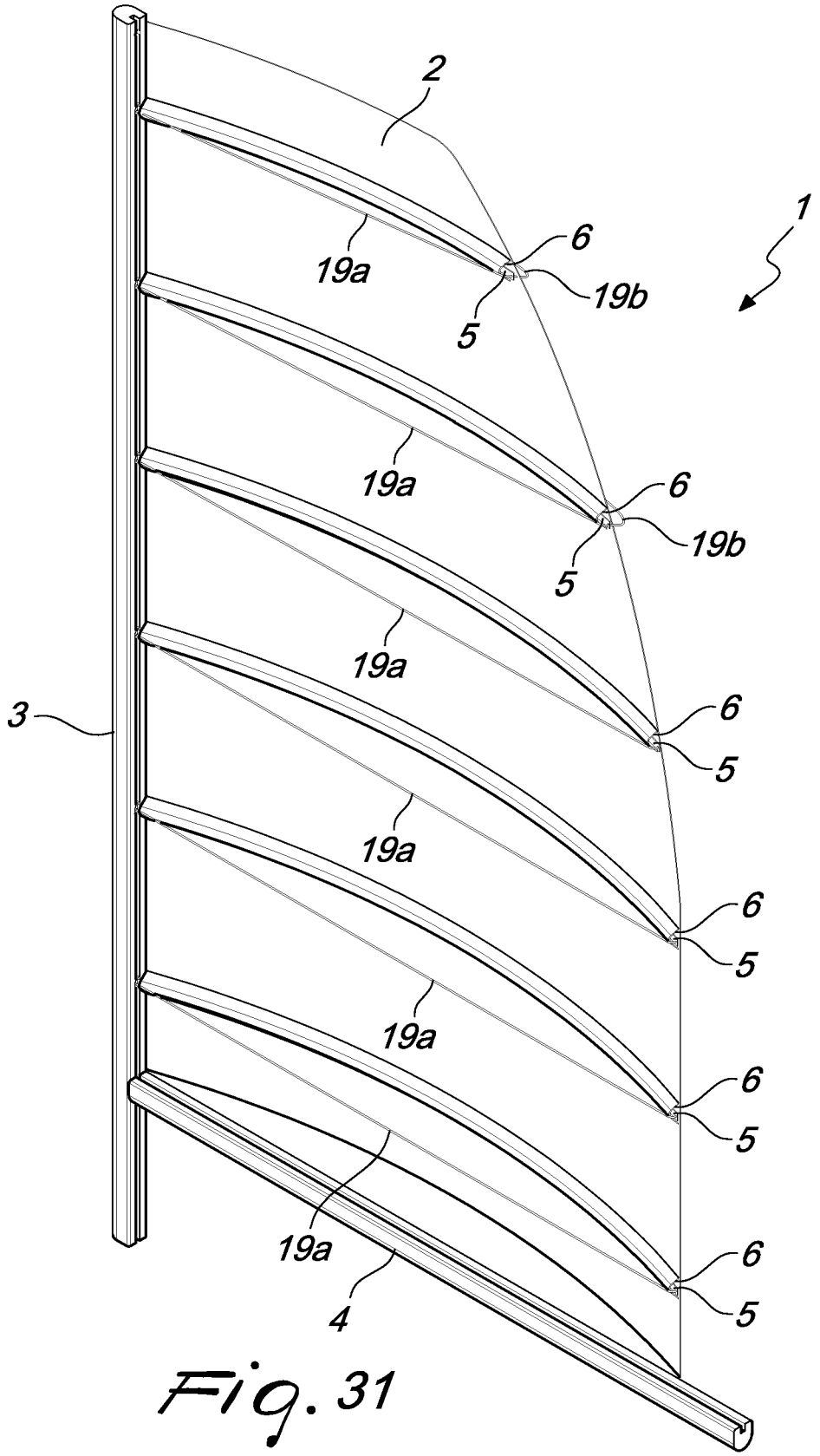
FIG. 31 is another perspective view of the third embodiment of the sail according to the invention.
Figure 32:
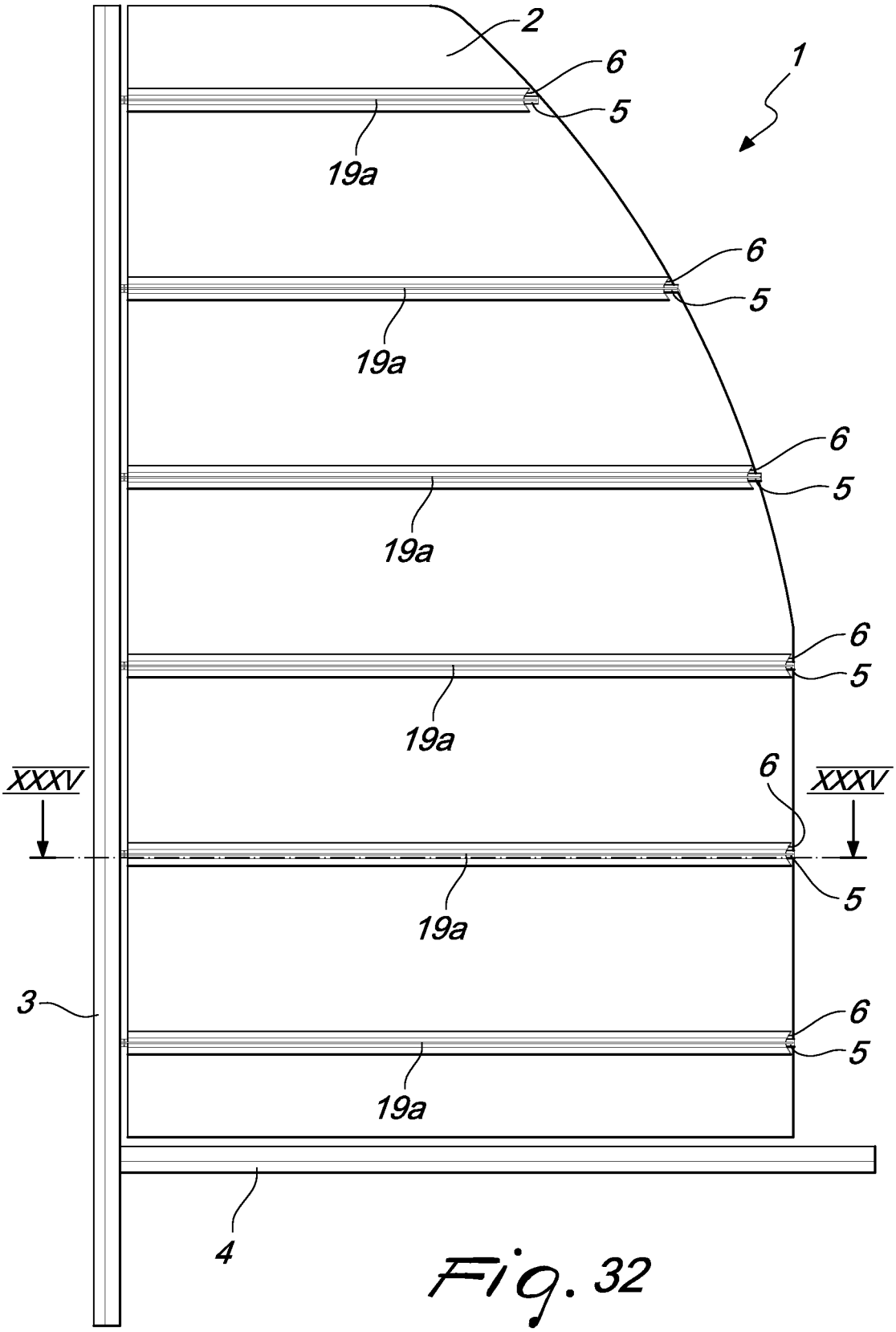
FIG. 32 is a front view of the third embodiment of the sail according to the invention.
Figure 33:
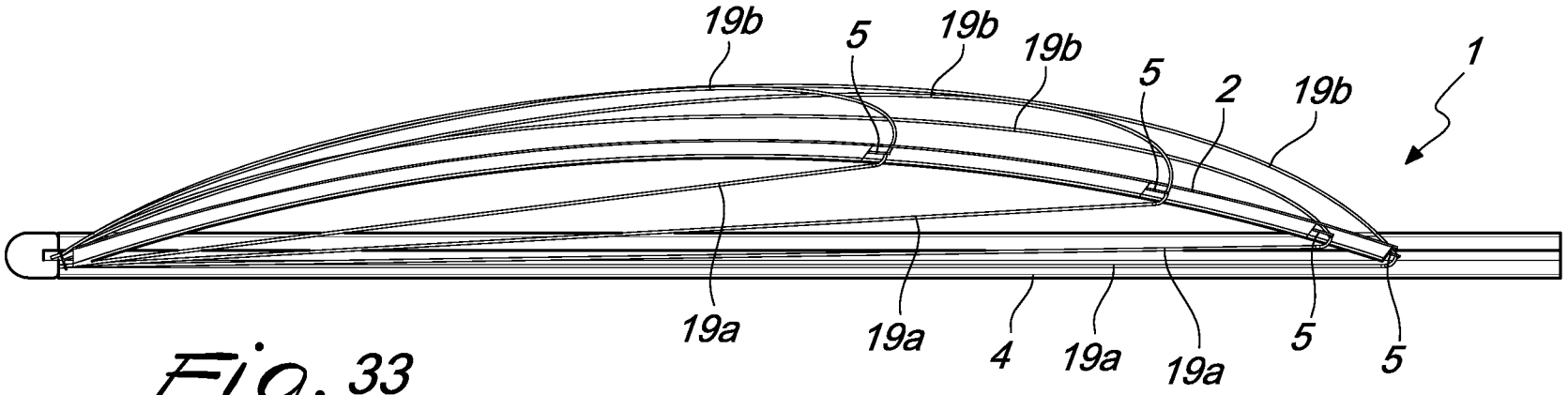
FIG. 33 is a top plan view of the third embodiment of the sail according to the invention.
Figure 34:
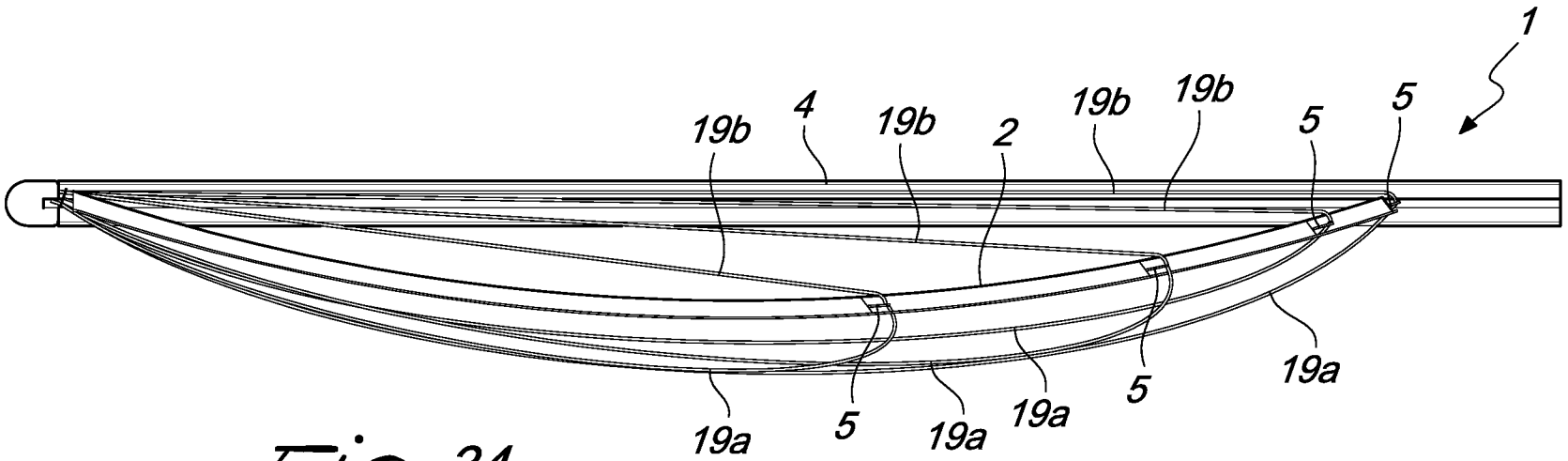
FIG. 34 is again a view of the third embodiment of the sail according to the invention but with a different orientation of the ribs with respect to FIG. 33.
Figure 35:
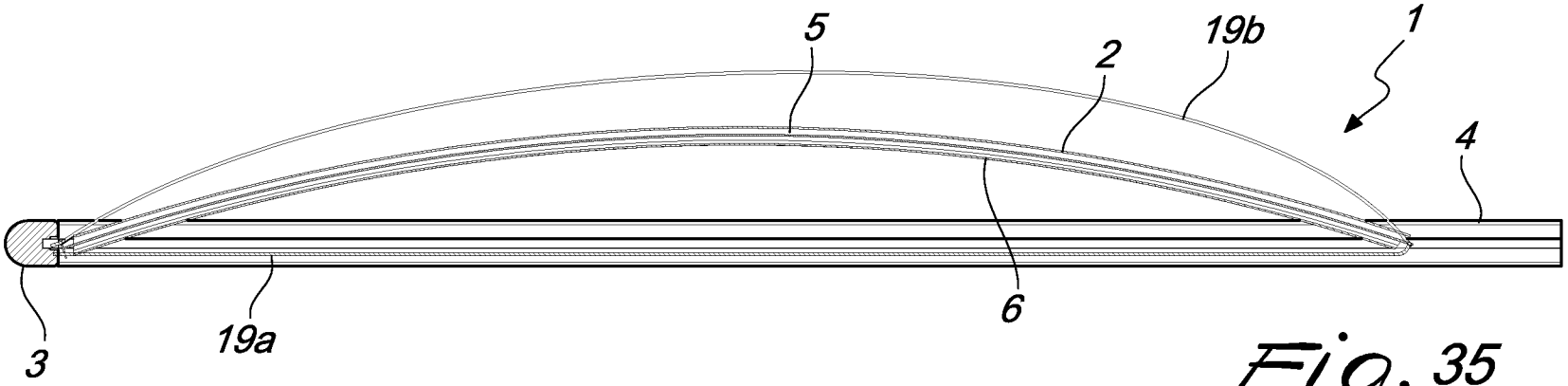
FIG. 35 is a sectional view taken along the plane XXXV-XXXV of FIG. 32.
Figure 36:
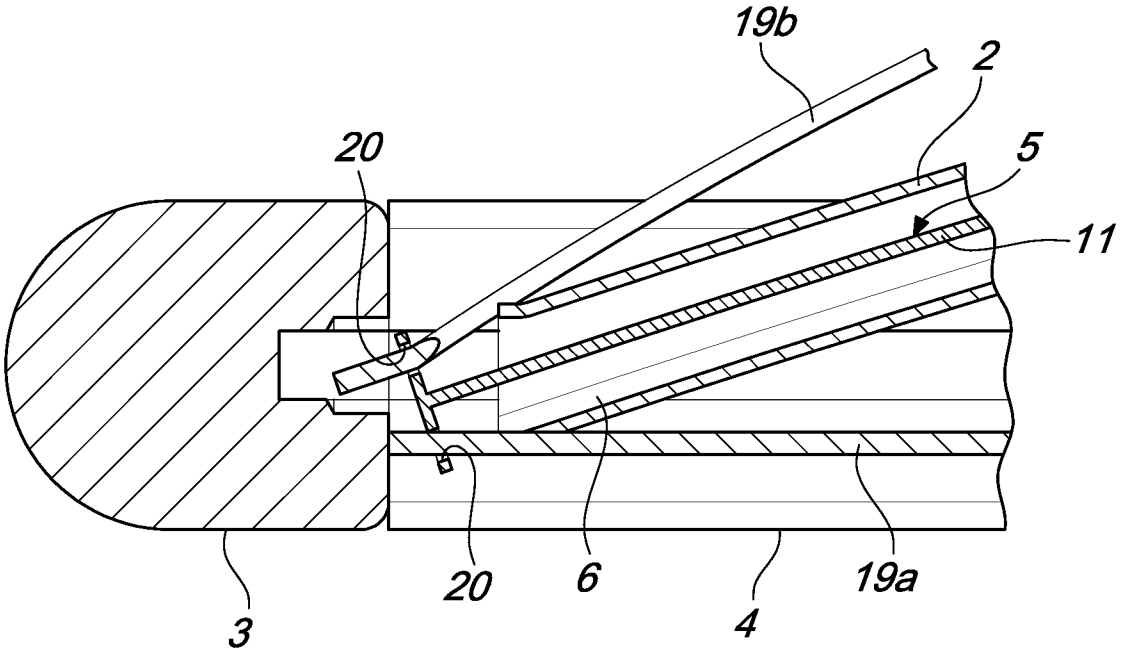
FIG. 36 is an enlarged-scale view of a detail of FIG. 35.
Figure 37:
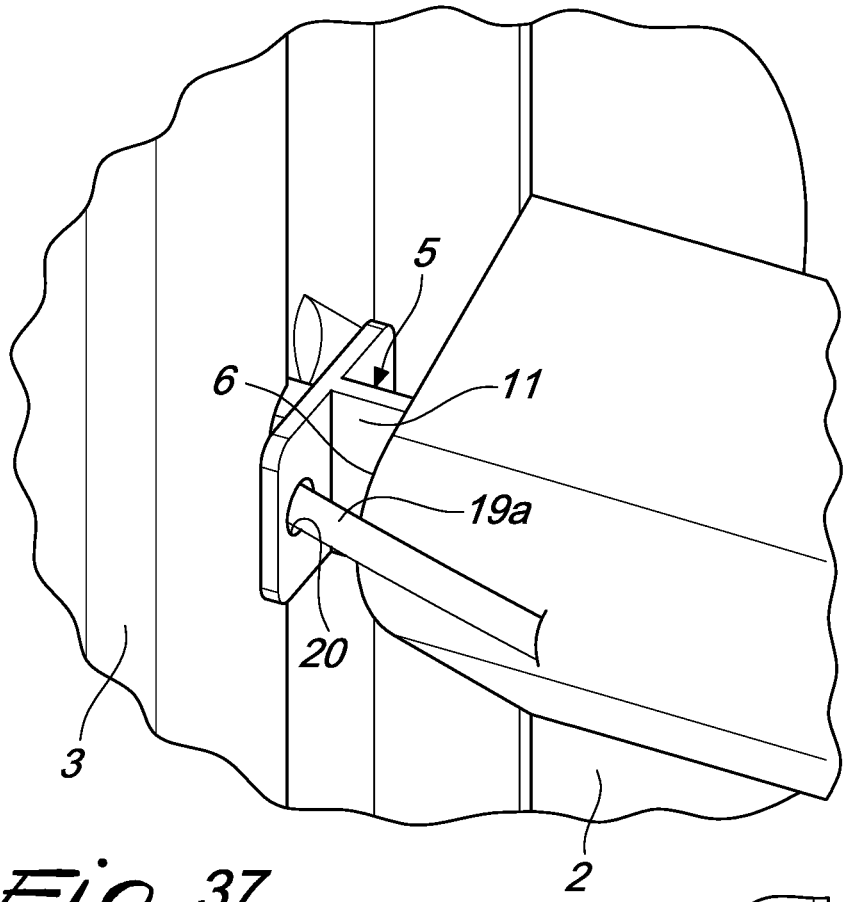
FIG. 37 is an enlarged-scale perspective view of a detail of the third embodiment of the sail according to the invention at one end of a rib.
Figure 38:
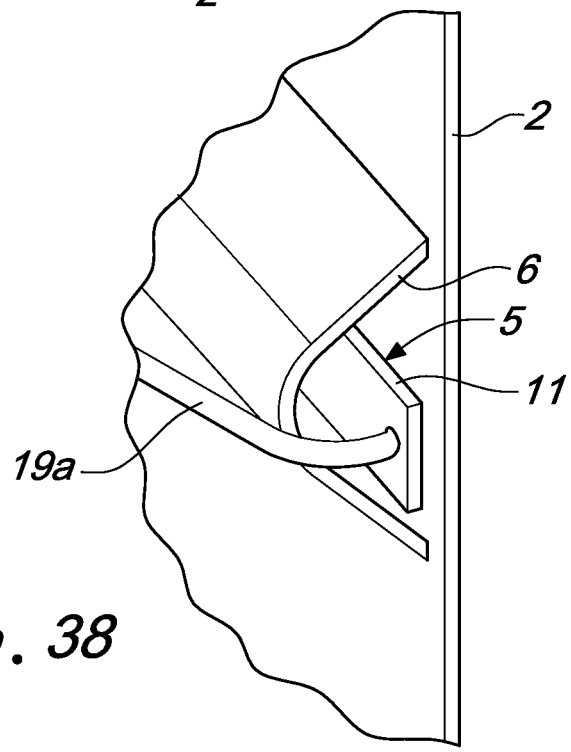
FIG. 38 is an enlarged-scale perspective view of another detail of the third embodiment of the sail according to the invention at the other end of the rib.
Figure 39:
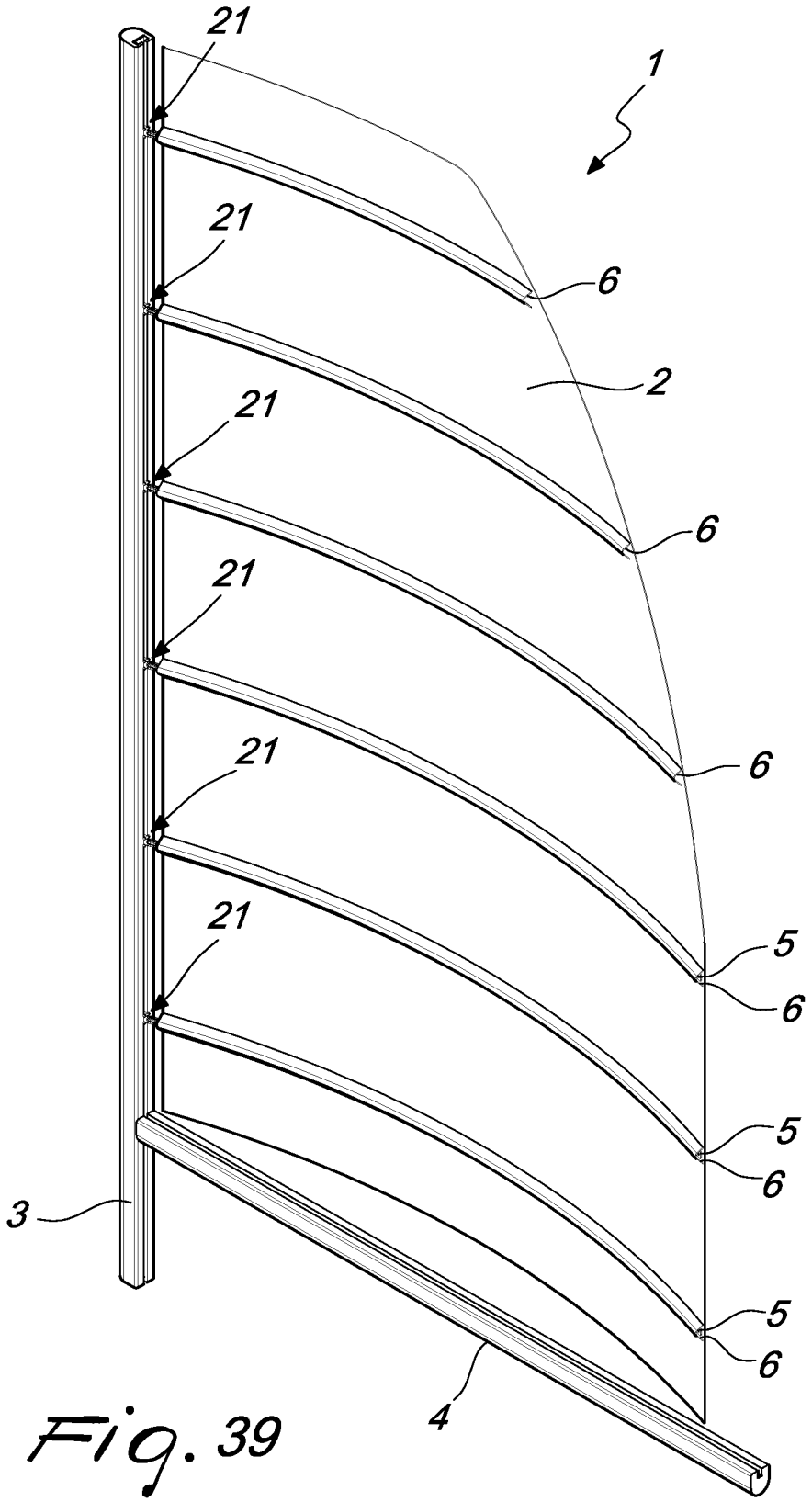
FIG. 39 is a perspective view of a fourth embodiment of the sail according to the invention.
Figure 40:
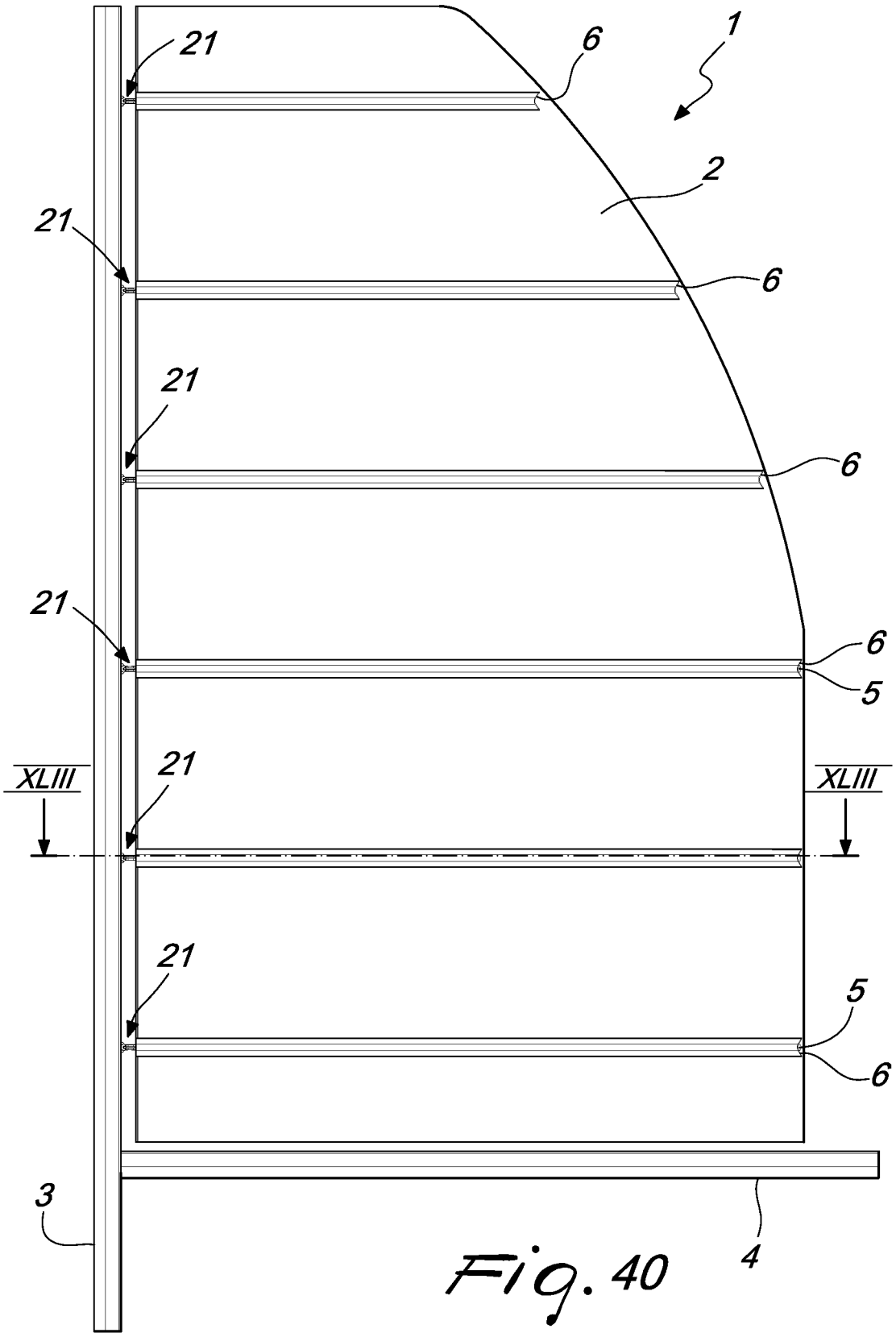
FIG. 40 is a front elevation view of the fourth embodiment of the sail according to the invention.
Figure 41:
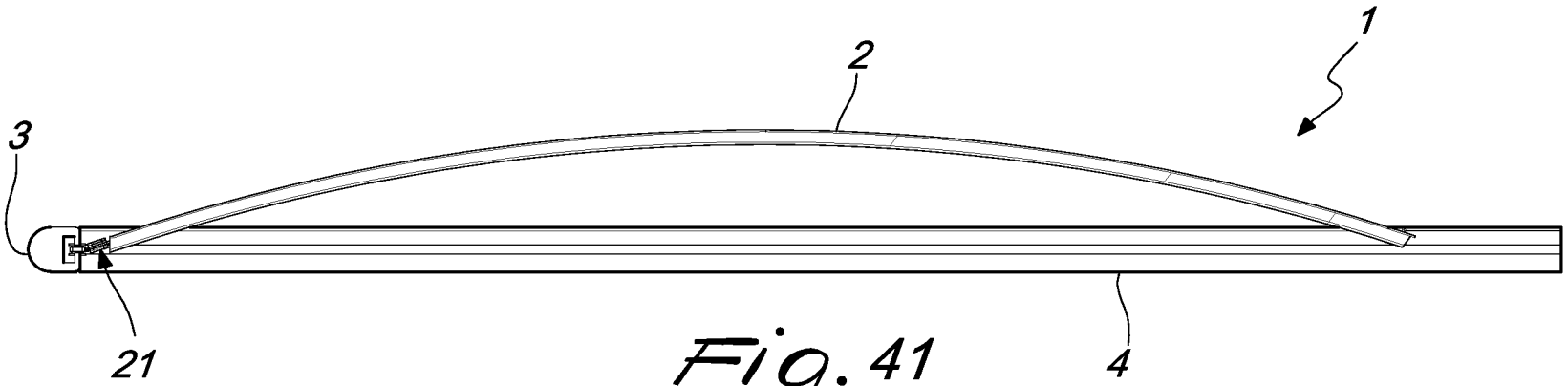
FIG. 41 is a top plan view of the fourth embodiment of the sail according to the invention.
Figure 42:
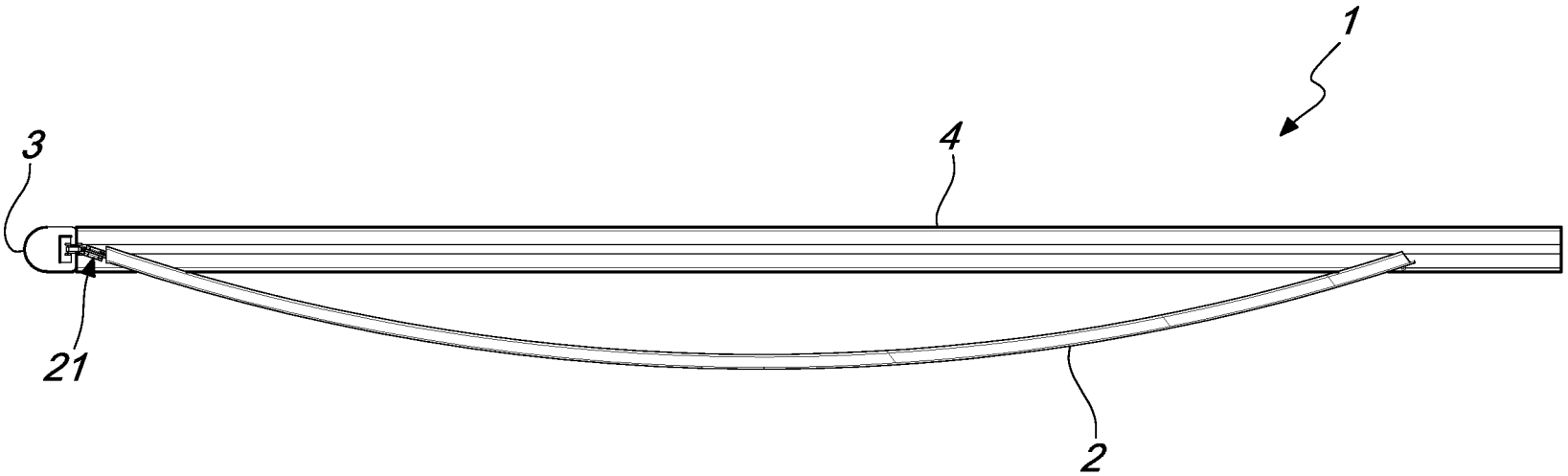
FIG. 42 is again a view of the fourth embodiment of the sail according to the invention but with a different orientation of the concavity of the ribs with respect to FIG. 41.
Figure 43:
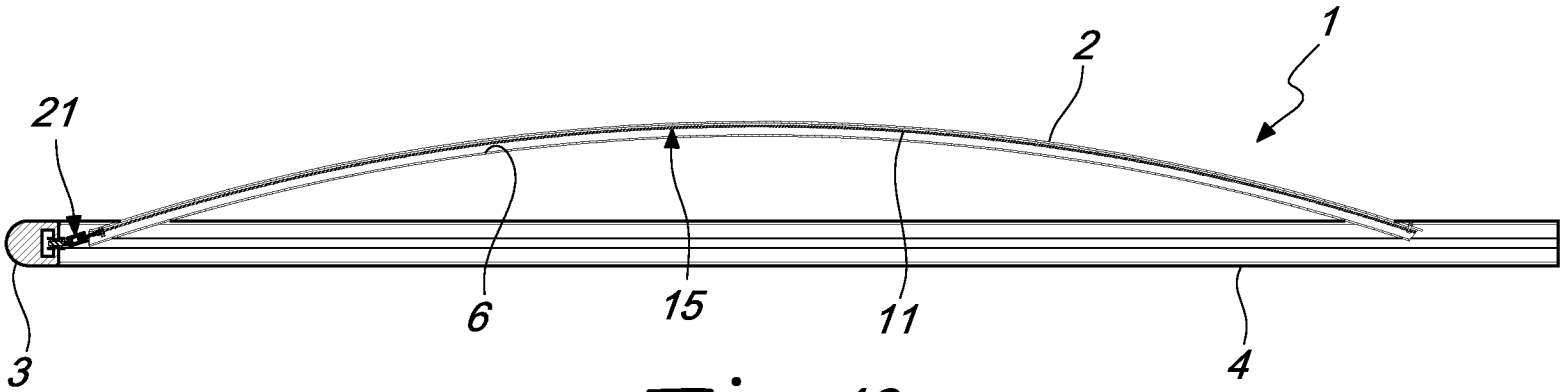
FIG. 43 is a sectional view taken along the plane XLIII-XLII of FIG. 40.
Figure 44:
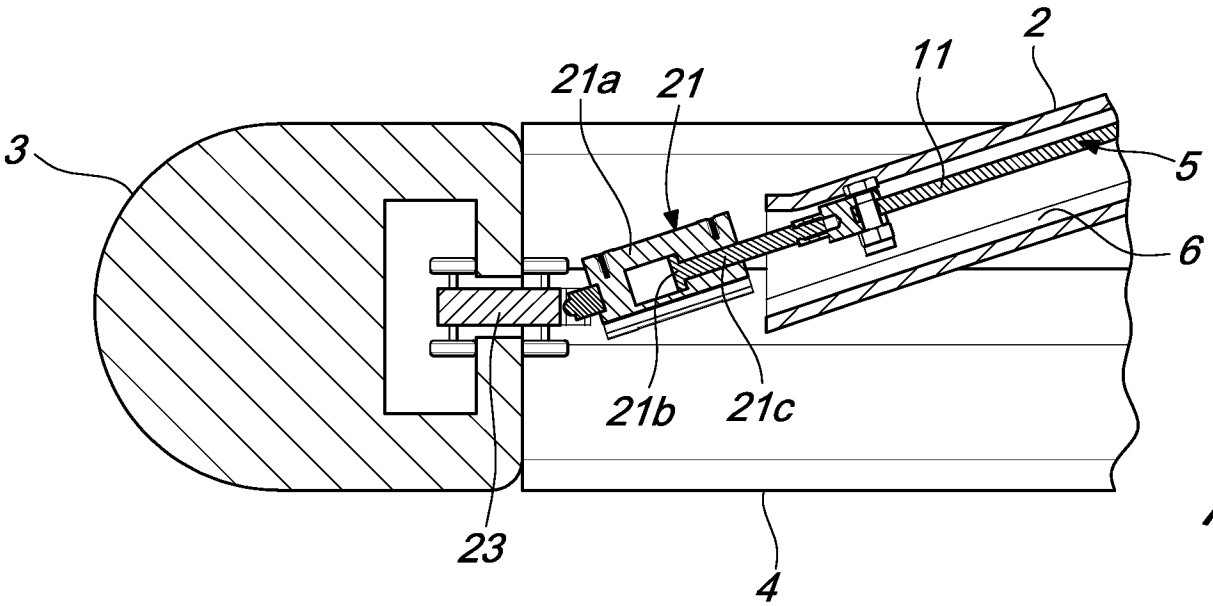
FIG. 44 is an enlarged-scale view of a detail of FIG. 43.

With reference to the figures, the sail for the propulsion of means of transport according to the invention, generally designated by the reference numeral 1, comprises a sheet-like body 2 made of elastically flexible material which is connected, at one of its edges, to a supporting mast 3, connected to a means of transport, not shown, such as a boat or other vehicle.

Advantageously, as shown, the sheet-like body 2, at its lower edge, is moreover connected, in a per se known manner, to a beam 4 (the boom), which is extended substantially at right angles to the supporting mast 3 and is connected thereto at one of its ends.

At least one stiffening rib 5 is associated with the sheet-like body 2 and is accommodated in a respective pocket 6 which is formed in the sheet-like body 2 and is extended for at least one portion of the sheet-like body 2 comprised between the supporting mast 3 and the edge of the sheet-like body 2 that is opposite with respect to the one connected to the supporting mast 3.

According to the invention, the or each rib 5 has, or can assume on command, a substantially arc-like shape adapted to generate lift, so as to be able to give the sheet-like body 2 of the sail according to the invention a substantially wing profile-like shape with a concave face and an opposite convex face.

Means for varying the orientation of the concave part of the or each rib 5 with respect to the supporting mast 3 are moreover provided, so as to allow the possibility to orient the concave part of the or each rib 5 and, therefore, the concave face of the sheet-like body 2 of the sail according to the invention, substantially toward the side of the means of transport from which the wind is coming.

More preferably, multiple stiffening ribs 5 arranged at mutually different heights with respect to the base of the supporting mast 3 are associated with the sheet-like body 2.

According to a first embodiment of the invention shown in FIGS. 1-10, each one of the ribs 5 is constituted by a rigid elongated body having an arc-like extension and conveniently provided with a circular shape in cross-section.

In this case, such means for varying the orientation of the concave part of the ribs 5 are constituted by means 7 for rotating the ribs 5 about a respective oscillation axis 5*a* that is substantially parallel to an axis that passes through the corresponding ends of the ribs.

Advantageously, the rotation means 7 comprise at least one traction element 8, for example constituted by a cable, which is conveniently supported by the supporting mast 3 and to which the ribs 5 are connected at one of their ends, more particularly at their end directed toward the supporting mast 3, by means of a respective actuation arm 9 which is extended substantially at right angles to the oscillation axis 5*a* of the corresponding rib 5.

Preferably, the traction element 8 unwinds around at least one snub pulley 10 supported rotatably by the supporting mast 3, substantially at the top thereof, so as to form at least one active portion 8*a*, substantially parallel to the axis of the supporting mast 3, to which the ribs 5 are connected by means of the corresponding actuation arm 9, and an inactive or return portion 8*b*, which is extended parallel to the active portion 8*a*.

The traction element 8 may also have a closed extension and run between two snub pulleys 10, both mounted rotatably on the supporting mast 3, one arranged above the ribs 5 and the other arranged below the ribs 5.

With reference to a second embodiment of the invention, shown in FIGS. 11 to 29, the ribs 5 each comprise at least one elastically flexible body 11 having an elongated extension.

In this case, bending means are provided that can be activated on command and are adapted to apply a bending moment to the elastically flexible body 11 of the ribs 5 in order to produce an arc-like bending of the elastically flexible body 11 of the ribs 5.

Advantageously, the bending means are adapted to apply a bending moment to the elastically flexible body of the ribs 5 in an adjustable manner, so as to allow the possibility to vary the extent of the arc-like bending imparted to said ribs and/or the orientation of the concavity assumed by the elastically flexible body 11 of the ribs 5 as a consequence of its arc-like bending.

It should be noted that it is possible to provide at least two different groups of ribs 5 arranged so as to be mutually superimposed along the longitudinal extension of the supporting mast 3, each one of the groups being able to comprise at least two ribs 5. For example, it is possible to divide the sheet-like body 2 of the sail into three superimposed bands, with each of which a respective group of ribs 5 can be associated.

Advantageously, the bending means are capable of applying a bending moment to the elastically flexible body 11 of each rib 5 in an independent manner with respect to the other ribs 5. As an alternative, the bending means can also be capable of applying a bending moment to the elastically flexible body 11 of at least one of the ribs 5 of each one of the groups of ribs 5 independently of the other groups of ribs 5.

The bending means may also be capable of applying to the elastically flexible body 11 of the ribs 5 a different bending moment according to the arrangement in height of the individual rib 5 or of the corresponding group of ribs 5, with respect to the base of the supporting mast 3.

More preferably, in the embodiment of the invention shown in FIGS. 11 to 29, the ribs 5 each comprise a pair of elastically flexible bodies 11*a*, 11*b* having an elongated extension which face each other and can slide with respect to each other along their longitudinal axis.

The elastically flexible bodies 11*a*, 11*b* of each rib 5 are conveniently mutually integrally connected at one of their ends, for example by means of a bolt 12 and a corresponding lock nut 13, while the bending means comprise, in this case, at the other end of the elastically flexible bodies 11*a*, 11*b*, compression means adapted to apply, selectively to one or the other of the elastically flexible bodies 11*a*, 11*b*, an axial compression force capable of causing their arc-like bending.

Conveniently, the compression means comprise a lever 14 which is interposed between said elastically flexible bodies and is hinged at one end to each one of said elastically flexible bodies 11*a*, 11*b* by means of respective rotation pivots 15*a*, 15*b* which are arranged so that their axes are mutually axially offset, so that a rotation of the lever 14 about the rotation pivots 15*a*, 15*b* in one direction or the other leads to an arc-like bending of the elastically flexible bodies with the concave part directed in one direction or the other.

Advantageously, the lever 14 is further connected at its other end to actuation means 16 for its rotation about the rotation pivots 15*a*, 15*b*.

For example, the actuation means 16 can be provided by a rope-like element 17, which has at least one first portion 17*a* that is extended substantially parallel to the axis of the supporting mast. The first portion 17*a* is coupled to the lever 14 of each rib 5, and is guided by a pulley 18 rotatably mounted at the top of the supporting mast 3, so as to define a second portion 17*b* that is substantially parallel to the axis of the supporting mast 3, so as to allow the axial movement of the first section 17*a* in one direction or the other and consequently actuate the rotation of the levers 14 about the corresponding rotation pivots 15*a*, 15*b* of the ribs 5 in one direction or the other.

According to a third embodiment shown in FIGS. 30 to 38, the ribs 5 can be each provided by a single elastically flexible body 11, while the flexible means can be in turn provided, for each rib 5, by a respective pair of tension members 19*a*, 19*b* which are arranged on mutually opposite sides with respect to the corresponding rib 5 and, more particularly, with respect to a central plane of the corresponding rib 5, substantially parallel to the axis of the supporting mast 3.

The tension members 19*a* and 19*b* are conveniently connected at one corresponding end thereof to one end of the corresponding rib 5 and can be actuated selectively by traction so as to produce the arc-like bending of the corresponding rib 5 with the concavity directed toward the respective side of the corresponding rib 5.

Advantageously, the tension members 19*a* and 19*b* are each provided by a respective rope or line, which can be arranged in traction by the user, at its end that is opposite with respect to the one at which it is connected to the elastically flexible body 11 of the respective rib 5.

Conveniently, the ropes that provide the traction elements 19*a*, 19*b* pass through a corresponding eye 20 defined at the end of the corresponding rib 5 that is directed toward the supporting mast 3 and can engage sheaves or rings, supported by the supporting mast and/or by the sheet-like body 2, which allow their guiding along the supporting mast 3, so as to allow the user to act selectively thereon, by means of a traction action, which is consequently transmitted to the corresponding rib 5.

According to a fourth embodiment of the sail according to the invention shown in FIGS. 39 to 48, the bending means comprise, for each one of the ribs 5, at least one respective control actuator 21 adapted to apply a thrusting action to one end of the elastically flexible body 11 of the corresponding rib 5.

Figure 46:
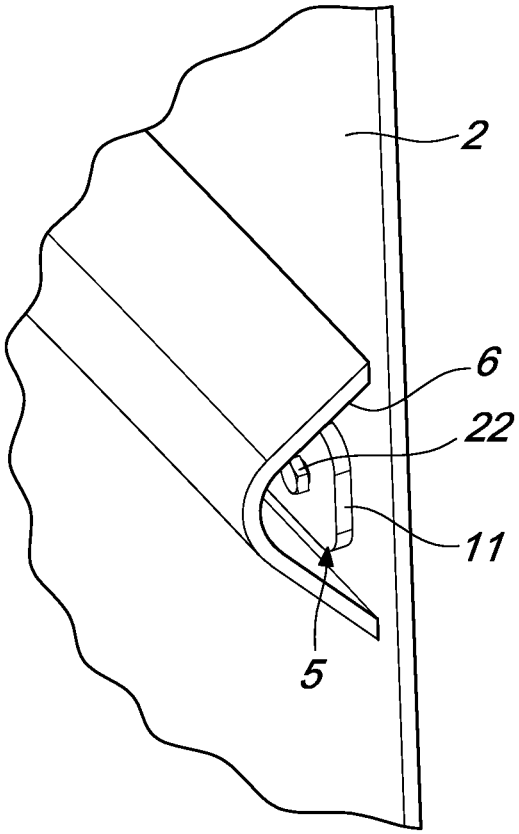
FIG. 46 is a perspective view of another detail of the fourth embodiment of the sail according to the invention at the other end of the rib.

Conveniently, in this case, the other end of the elastically flexible body 11 of the ribs 5 is fixed to the sheet-like body 2 of the sail by means of a connecting element 22, such as for example a bolt or others, as shown in FIG. 46.

Conveniently, each control actuator 21 is of the fluid-operated type and comprises a cylinder 21*a* and a piston 21*b*, which can move in the cylinder 21*a* and is connected by means of a stem 21*c* to the elastically flexible body 11 of the corresponding rib 5.

Advantageously, with this arrangement, when the stem 21*c* is in the fully retracted position the elastically flexible body is substantially in a non-deformed rectilinear condition, while when the stem 21*c* is in an extracted position the elastically flexible body is in a deformed condition and assumes an arc-like shape. Therefore, by varying the degree of extraction of the stem 21*c* from the cylinder 21*a* it is thus possible to vary also the degree of deformation, i.e., of bending, of the rib 5.

Figure 45:
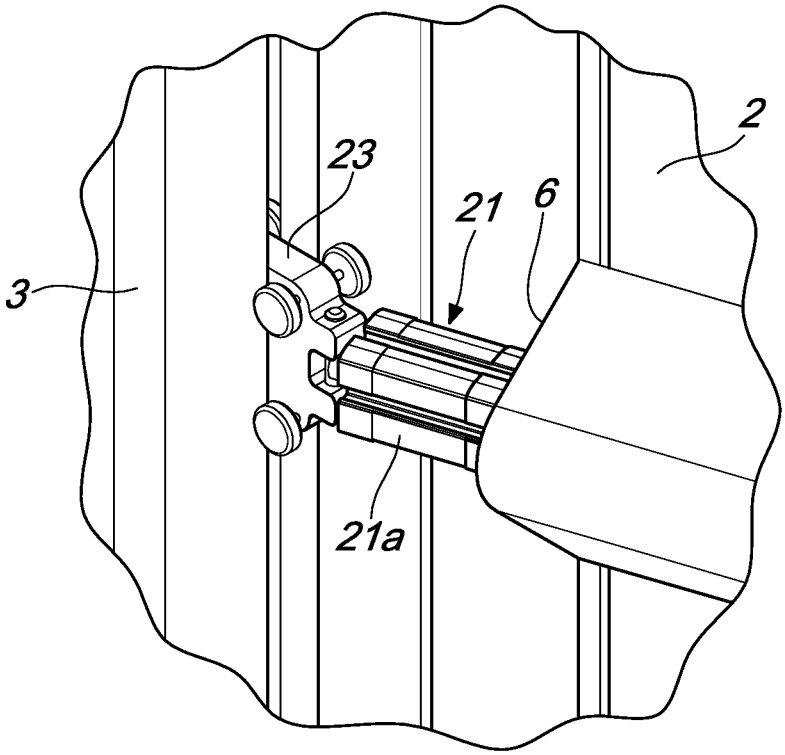
FIG. 45 is a perspective view of a detail of the fourth embodiment of the sail according to the invention at one end of a rib.

Conveniently, as highlighted particularly in FIG. 45, the control actuator 21 is supported, advantageously in an articulated manner, by a respective carriage 23, which is slidingly movable along the supporting mast 3.

Preferably, in this embodiment, at least two separate and mutually superimposed regions or bands, preferably at least three, such as for example a lower band, an intermediate band and an upper band, are formed in the sheet-like body 2 of the sail; a respective group of ribs 5, each formed preferably by at least two ribs 5, is associated with each one of the bands. In this manner, by virtue of an independent control of the deformation of the ribs 5 of the various groups of ribs 5 present on the sheet-like body 2 of the sail, obtained by means of a different actuation of the corresponding control actuators 21, it is possible to make the sheet-like body 2 of the sail assume a broad range of different configurations, depending on the wind conditions that are present or on the desired means of transport.

Figure 47:
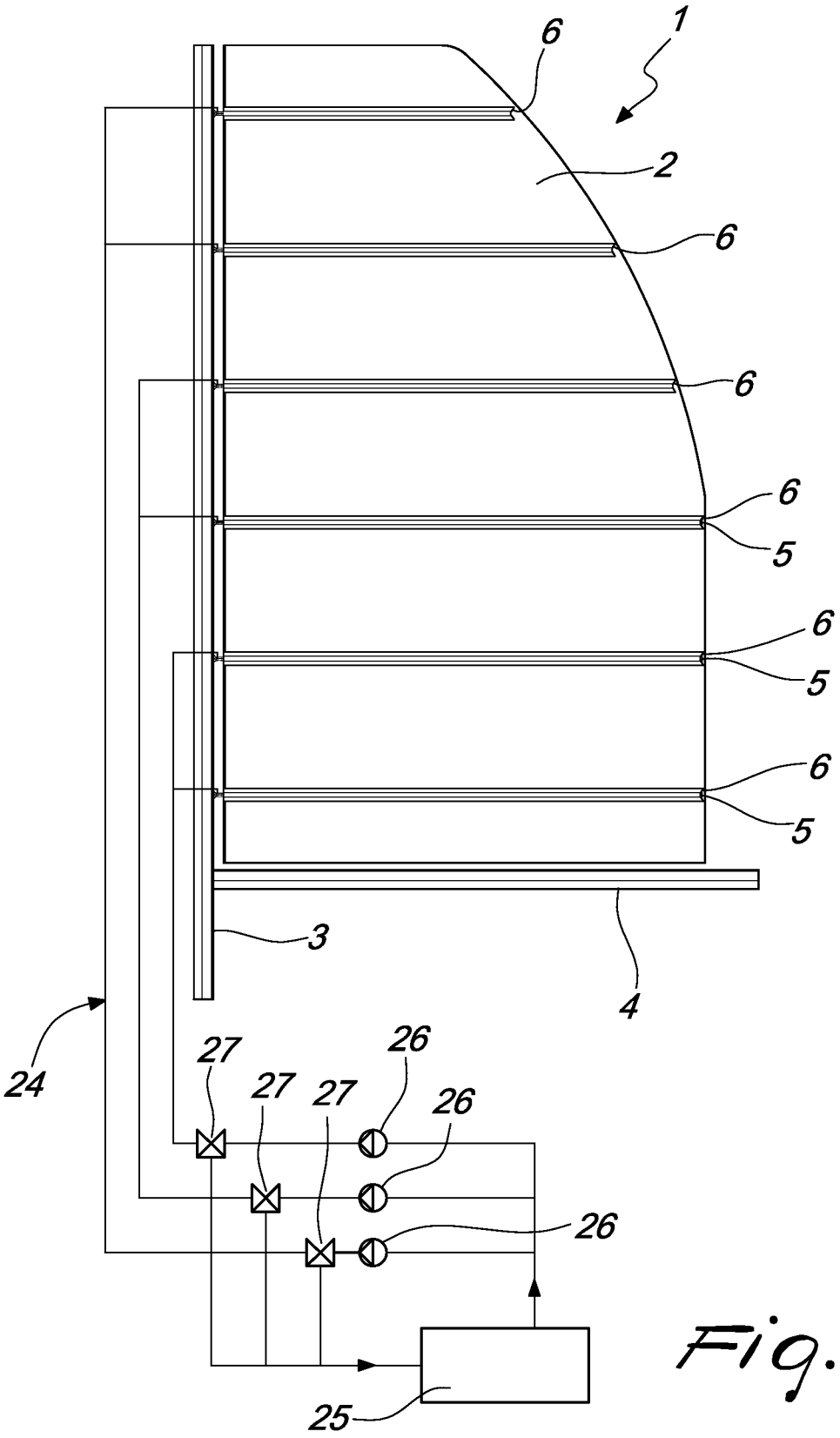
FIG. 47 is a diagram of the fourth embodiment of the sail according to the invention.
Figure 48:
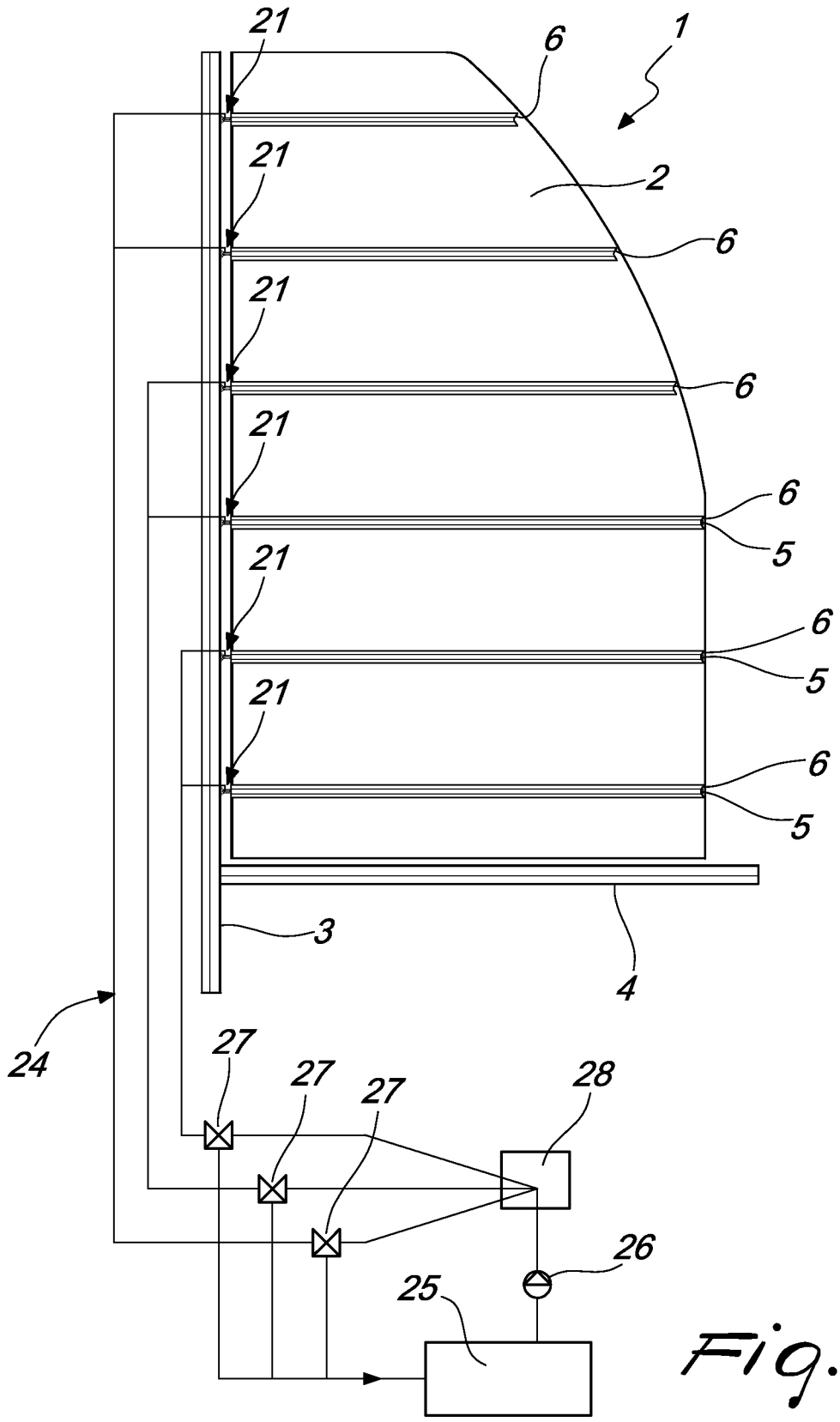
FIG. 48 is a view of a variation of the diagram of FIG. 47.

With reference to FIG. 47, it can be noticed that the control actuator 21 of each rib 5 can be connected to a fluid-operated circuit 24, which comprises at least one source of pressurized fluid, constituted for example by a tank 25 and by at least one supply pump 26, and at least one regulator valve 27 for the control actuator 21 of each rib 5 or for the control actuators 21 of each group of ribs 5.

Advantageously, each regulator valve 27 is of the three-way type, of which one first way, in particular, is connected to a delivery duct leading to one or more control actuators 21, one second way is connected to the tank 25, in order to allow the discharge of the fluid from the cylinders 21*a* of the actuators 21, and one third way is connected to a duct for supplying the pressurized fluid that arrives from the or a respective supply pump 26, in order to allow the introduction of the pressurized fluid into the cylinders 21*a* of the control actuators 21.

Optionally, it is possible to establish also that an electronic controller 28 can be associated with the fluid-operated circuit 24, conveniently provided with memory and functionally connected to the regulator valves 27 which, in this case are conveniently constituted by electric valves, so as to be able to actuate an at least partially automatic control of the shape assumed by the ribs 5 when there is a change in the wind conditions or in the point of sail of the means of transport with which the sail is associated.

The operation of the sail according to the invention is as follows.

With reference to the embodiment of FIGS. 1 to 10, the user, by acting on the traction element 8, may cause the rotation of the ribs 5 about their oscillation axis 5*a*, so as to be able to vary the orientation of the concave part of the ribs 5 according to the direction from which the wind blows, thus giving the sail stably a wing profile-like shape suitable to receive the thrust of the wind.

With reference to the embodiment of FIGS. 11-29, the user can act, by virtue of the actuation means 16, on the levers 14 of the ribs 5, so as to vary with continuity the shape of the ribs 5 from rectilinear to arc-like, and vice versa, so as to give the sail the wing profile-like shape that is best suited to the conditions and the direction of the wind with respect to the travel direction of the means of transport.

In the embodiment of FIGS. 30-38, the user, in order to modify with continuity the shape of the ribs 5 and give said ribs a rectilinear or substantially arc-like shape, according to the requirements, may instead intervene by acting selectively on the tension members 19*a*, 19*b* until the sail is made to assume desired wing profile-like shape.

With reference now to the embodiment of FIGS. 39-47, with the stem 21*c* connected to the piston 21*b* of the control actuator 21 of each rib 5 in the retracted position, the elastically flexible body 11 of the ribs 5 is in a neutral condition, i.e., in a non-deformed rectilinear condition.

When a single rib 5 in neutral condition and with the direction of the wind parallel thereto is oriented, as a consequence of a movement of the sail, with respect to the direction of the wind, i.e., is inclined by a few degrees with respect to the wind flow, due to this inclination an initial bending of the rib 5 is generated which is due to the incidence of the wind on the sheet-like body 2 of the sail, immediately after which the user will be able to actuate the corresponding control actuator 21, acting by means of the corresponding regulator valve 27, so as to be able to increase and adjust the bending of the rib 5 that has already been triggered by the position of the sail with respect to the wind.

Likewise, when the sail is oriented on the opposite side, as a consequence for example of a turn or of a change of direction of the wind, a triggering of the bending of the rib 5 on the opposite side is generated and the user can immediately increase it and adjust it by means of the actuation of the corresponding control actuator 21.

Moreover, by virtue of the possibility to act in a differentiated manner on the various regulator valves 27, the user can decide to actuate only some control actuators 21 at a time, so as to be able to actuate in a different manner the various groups of ribs 5 associated with the various bands into which the sheet-like body 2 of the sail is divided and so as to have different adjustments of the ribs 5 as a function of their position in height with respect to the footing of the supporting mast 3.

With reference to the variation of FIG. 49, it is also possible to provide the possibility to perform an at least partially automatic or "semi-automatic" control of the shape of the ribs 5.

In particular, in this case, the user must initially perform manually the calibrations deemed necessary on the sail and, particularly, by acting on the regulator valves 27, adjust the shape of the various ribs 5, as he deems best, in order to increase the efficiency of the sail in the wind, while the electronic controller 28 in turn records the last calibration considered optimum.

If, for example, the means of transport to which the sail is connected is constituted by a boat, when a turn is made the electronic controller 28 performs a cycle of operations, which comprise the lowering of the pressure in the fluid-operated circuit 24, so as to bring the stem 21*c* of the control actuators 21 to a retracted position and the corresponding ribs 5 to a neutral condition, when the boat reaches the condition in which it is oriented substantially parallel to the direction of the wind, and the subsequent increase of the pressure in the fluid-operated circuit 24, in order to bend in an arc-like manner the ribs 5 on the opposite side, restoring a condition of adjustment of the sail that mirrors the previous one, with respect to the longitudinal axis of the boat.

This cycle will be repeated at each turn, always storing the last adjustment.

In practice it has been found that the invention achieves the intended aim and objects, providing a sail for the propulsion of means of transport that is capable of assuming a stable wing profile-like shape, regardless of the angle of incidence of the wind.

Another advantage of the invention is that it allows the means of transport to close-haul with narrower angles with respect to the wind direction and to reduce, therefore, the path needed to sail against the wind, with respect to the background art.

Due to its particular structure, the sail according to the invention allows furthermore to prevent even small variations of trim due to wave motion from being able to modify the wing profile-like shape of the sail, penalizing the speed of the means of transport.

Another advantage of the invention is to allow a more direct adjustment of the shape of the sail with respect to the background art.

It should also be noted that the sail according to the invention allows to combine the performance advantages of rigid sails with the practicality and cost advantages of traditional sails.

Moreover, the sail according to the invention allows to provide any boat, or other means of transport with sail-based propulsion, with wing profile-like sails, without requiring modifications to said boat.

Another particular aspect of the sail according to the invention is to be able to use ribs that, differently from currently known ones, have, or can assume, in a stable manner, an arc-like geometry, being able to vary with continuity, at least in some embodiments of the invention, their own shape from rectilinear to arc-like and vice versa.

Finally, it should be noted that the fourth embodiment of the invention offers in particular also the following advantages with respect to the background art and to the use of preloaded ribs:

- the possibility to manage the bending of the ribs of the sail based on the changing wind conditions;
- the possibility to discharge any preloading of the ribs at each turn, so that no elastic snap actions occur;
- the possibility to discharge the preloading of the ribs each time the sail is hauled down, an advantage that greatly extends the useful installed lifespan of the sail.

The invention thus conceived is susceptible of numerous modifications and variations, all of which are within the scope of the appended claims; all the details may furthermore be replaced with other technically equivalent elements.

in particular, it is important to highlight that the means for performing the bending of the ribs, in the various embodiments, can be integral with the supporting mast or integral with the body of the sail, with the advantage in this latter case of being able to haul down the sail without problems. As an alternative, it is possible to also adopt the use of a mixed scheme.

In practice, the materials used, so long as they are compatible with the specific use, as well as the contingent shapes and dimensions, may be any according to the requirements and the state of the art.

The disclosures in Italian Patent Applications No. 102020000003440 and 102020000017620 from which this application claims priority are incorporated herein by reference.

What is claimed is:

1. A sail comprising a sheet body comprised of flexible material which is connected at a first edge to a supporting mast, said sheet body comprising at least one pocket containing at least one stiffening rib which at least one stiffening rib extends between said supporting mast and a second edge of said sheet body that is opposite to the first edge of said sheet body that is connected to said supporting mast, wherein said at least one stiffening rib comprises a concave, substantially arc shape adapted to generate lift, at least one traction element connecting said ribs at one end for varying an orientation of said at least one stiffening rib with respect to said supporting mast wherein said at least one stiffening ribs comprises at least one flexible body having an elongated extension, said at least one stiffening rib having a bending moment applied thereto, in order to produce an arc-shaped bending of said at least one flexible body.

2. The sail according to claim 1, further comprising a plurality of stiffening ribs arranged at mutually different heights with respect to a base of said supporting mast.

3. The sail according to claim 1, wherein said at least one stiffening rib has a bending moment applied thereto in an adjustable manner in order to vary an extent of said arc-shaped bending of said at least one flexible body.

4. The sail according to claim 3, wherein said at least one stiffening rib has a bending moment applied thereto in an adjustable manner to vary a concave orientation of the flexible body following said arc-shaped bending.

5. The sail according to claim 1, further comprising at least two different groups of ribs arranged mutually superimposed along a longitudinal extension of said supporting mast, each one of said groups of ribs comprise at least two ribs.

6. The sail according to claim 1, wherein said at least one stiffening rib has a bending moment applied thereto, in an independent manner with respect to at least one other rib.

7. The sail according to claim 1, wherein said at least one stiffening rib has a bending moment applied thereto that is different according to an arrangement in height of an individual rib or of a corresponding group of ribs, with respect to a base of said supporting mast.

8. The sail according to claim 1, wherein said at least one stiffening rib comprises a pair of elastically flexible bodies having an elongated extension which face each other and can slide with respect to each other along a longitudinal axis, said elastically flexible bodies being mutually integrally connected at one end, said at least one stiffening rib having a bending moment applied thereto at another end of said elastically flexible bodies, and compression means adapted to apply, selectively on one or the other of said elastically flexible bodies, an axial compression force.

9. The sail according to claim 8, wherein said compression means comprise a lever interposed between said elastically flexible bodies and hinged at one end to each one of said elastically flexible bodies by means of at least two respective rotation pivots which are arranged so that axes thereof are mutually axially offset, said lever being connected at another end thereof to an actuation means for rotation about said rotation pivots.

10. The sail according to claim 1, wherein said at least one stiffening rib has a bending moment applied thereto and comprises, for each one of said at least one stiffening ribs, a respective pair of tension members are arranged on mutually opposite sides with respect to a corresponding stiffening rib and are connected to one end of a corresponding rib, said tension members being actuatable selectively by traction to produce an arc-shaped bending of the corresponding rib.

11. The sail according to claim 1, wherein said at least one stiffening rib has a bending moment applied thereto and comprises, for each one of said at least one stiffening ribs, at least one control actuator adapted to apply a thrusting action to one end of an elastically flexible body of at least one corresponding stiffening rib.

12. The sail according to claim 11, wherein said control actuator is supported by a respective carriage which is slidingly movable along said supporting mast.

13. The sail according to claim 11, wherein the control actuator of each rib is connected to a fluid-operated circuit comprising at least one source of pressurized fluid and at least one regulator valve for each rib or for each group of ribs.

14. The sail according to claim 13, wherein at least one controller functionally connected to said at least one regulator valve is in communication with said circuit.

* * * * *